US010012928B2

(12) United States Patent
Iwata

(10) Patent No.: US 10,012,928 B2
(45) Date of Patent: Jul. 3, 2018

(54) DEVELOPING APPARATUS

(71) Applicant: S-Printing Solution Co., Ltd., Suwon-si, Gyeonggi-do (KR)

(72) Inventor: Naoya Iwata, Yokohama (JP)

(73) Assignee: S-PRINTING SOLUTION CO., LTD., Suwon-Si (KR)

( * ) Notice: Subject to any disclaimer, the term of this patent is extended or adjusted under 35 U.S.C. 154(b) by 0 days.

(21) Appl. No.: 15/504,949

(22) PCT Filed: Sep. 3, 2015

(86) PCT No.: PCT/KR2015/009302
§ 371 (c)(1),
(2) Date: Feb. 17, 2017

(87) PCT Pub. No.: WO2016/036164
PCT Pub. Date: Mar. 10, 2016

(65) Prior Publication Data

US 2017/0248868 A1 Aug. 31, 2017

(30) Foreign Application Priority Data

Sep. 3, 2014 (JP) ..... 2014-179451
Aug. 26, 2015 (JP) ..... 2015-166599

(51) Int. Cl.
*G03G 15/08* (2006.01)

(52) U.S. Cl.
CPC ..... *G03G 15/0812* (2013.01); *G03G 15/0808* (2013.01); *G03G 15/0891* (2013.01);
(Continued)

(58) Field of Classification Search
CPC ..... G03G 15/0812; G03G 15/0891; G03G 2215/083; G03G 2215/0833;
(Continued)

(56) References Cited

U.S. PATENT DOCUMENTS 9,098,018 B2 8/2015 Kashimoto et al.
9,217,957 B2 12/2015 Ishida
(Continued)

FOREIGN PATENT DOCUMENTS

JP 2-21591 1/1990
JP 2002-072686 3/2002
(Continued)

OTHER PUBLICATIONS

International Search Report dated Dec. 15, 2015 in corresponding Application No. PCT/KR2015/009302.
(Continued)

*Primary Examiner* — Sandra Brase
(74) *Attorney, Agent, or Firm* — Staas & Halsey LLP

(57) ABSTRACT

A developing apparatus capable of suppressing an excessive discharge of developer from a developer discharge hole is disclosed. A first opening part through which developer is carried from a first case part to a second case part, and a developer discharge hole through which the developer is discharged are provided to the first case part. A first carrying member includes a counter blade between the first opening part and the developer discharge hole. The counter blade carries the developer in an opposite direction to a carrying direction of a first carrying blade of the first carrying member. A gap is prepared between an upper part of the counter blade and the first case part. A cross-sectional area of a discharge path for the developer from the counter blade to the developer discharge hole changes according to a progress of the developer along the discharge path.

20 Claims, 23 Drawing Sheets

(52) U.S. Cl.
CPC ..... *G03G 2215/083* (2013.01); *G03G 2215/0833* (2013.01)

(58) Field of Classification Search
CPC ... G03G 2215/0822; G03G 2215/0819; G03G 15/0822; G03G 15/0893
See application file for complete search history.

(56) References Cited

U.S. PATENT DOCUMENTS

| | | | | |
|---|---|---|---|---|
| 2009/0129820 | A1 | 5/2009 | Kohno et al. | |
| 2009/0214266 | A1* | 8/2009 | Kato ..... | G03G 15/0893 399/254 |
| 2010/0239322 | A1 | 9/2010 | Kido | |
| 2011/0150537 | A1 | 6/2011 | Watanabe et al. | |
| 2011/0236074 | A1* | 9/2011 | Maeda ..... | G03G 15/0893 399/254 |
| 2012/0177412 | A1* | 7/2012 | Watanabe ..... | G03G 15/0189 399/256 |
| 2012/0201573 | A1* | 8/2012 | Watanabe ..... | G03G 15/0853 399/256 |
| 2015/0132027 | A1 | 5/2015 | Kashimoto et al. | |
| 2015/0277294 | A1* | 10/2015 | Kurihara ..... | G03G 15/0891 399/254 |

FOREIGN PATENT DOCUMENTS

| | | |
|---|---|---|
| JP | 2006-293214 | 10/2006 |
| JP | 2009-122534 | 6/2009 |
| JP | 2009-192701 | 8/2009 |
| JP | 2010-160205 | 7/2010 |
| JP | 2010-186099 | 8/2010 |
| JP | 2010-224105 | 10/2010 |
| JP | 2011-128527 | 6/2011 |
| JP | 2013-25123 | 2/2013 |
| JP | 5590733 | 9/2014 |
| JP | 2015-22261 | 2/2015 |
| JP | 2015-94816 | 5/2015 |
| JP | 2015-094816 | 5/2015 |

OTHER PUBLICATIONS

Written Opinion dated Dec. 15, 2015 in corresponding International Patent Application No. PCT/KR2015/009302.

* cited by examiner

DEVELOPING APPARATUS

CROSS-REFERENCE TO RELATED APPLICATIONS

This application is a U.S. National Stage Application, which claims the benefit under 35 U.S.C. § 371 of PCT International Patent Application No. PCT/KR2015/009302, filed Sep. 3, 2015 which claims the foreign priority benefit under 35 U.S.C. § 119 of Japanese Patent Application No. 2014-179451, filed Sep. 3, 2014 and Japanese Patent Application No. 2015-166599, filed Aug. 26, 2015, the contents of which are incorporated herein by reference.

TECHNICAL FIELD

A developing apparatus is disclosed.

BACKGROUND ART

In electronic photographing technology, developing apparatuses using a two-component developer are used. The developing apparatuses mix a new carrier with toner when the toner is supplied and supply the carrier-mixed toner into a developer accommodation chamber, which ensures a long life of the developer. In addition, the developing apparatuses discharge old developer through a developer discharge hole. For example, JP 2014-115324 discloses a developing apparatus for discharging old developer through a developer discharge hole.

DETAILED DESCRIPTION OF THE INVENTION

Technical Problem

In a developing apparatus having a developer discharge hole, developer distributed in a developer accommodation chamber may be unintentionally discharged through the developer discharge hole along with a flow of air due to an increase in internal pressure or the like. Accordingly, in the present technical field, there is demand to suppress an excessive discharge of developer from a developing apparatus.

Therefore, provided is a developing apparatus capable of suppressing an excessive discharge of developer from a developer discharge hole.

Technical Solution

According to an aspect of an embodiment, a developing apparatus includes: first and second case parts; first and second opening parts for allowing the first and second case parts to communicate with each other; a developing roller installed in the first case part; a first carrying member installed in the first case part to carry, towards the first opening part, developer introduced from the second case part through the second opening part and to supply the developer to the developing roller; a second carrying member installed in the second case part to carry, towards the second opening part, the developer introduced from the first case part through the first opening part; and a developer discharge hole provided in the first case part at an opposite side to the second opening part, wherein the first carrying member includes a carrying blade for carrying the developer towards the first opening part and a counter blade located between the first opening part and the developer discharge hole to carry the developer towards the first opening part, a gap is prepared between the counter blade and an inner wall of the first case part, and a cross-sectional area of a discharge path for the developer from the counter blade to the developer discharge hole within the first case part is changed according to a progress of the developer along the discharge path.

The cross-sectional area of the discharge path may be stepwise decreased towards the developer discharge hole.

The discharge path may include a first path part and a second path part adjacent to the first path part and located closer to the developer discharge hole than the first path part, and when a cross-sectional area of a part of the first carrying member located on the first path part is A, and a cross-sectional area of the second path part is B, a relationship of A>B may be satisfied.

The cross-sectional area of the discharge path may be continuously decreased towards the developer discharge hole.

A difference between the cross-sectional area of the discharge path and a cross-sectional area of the first carrying member may be decreased towards the developer discharge hole.

In the discharge path, when a gap between a lower end of the first carrying member and a lower surface of a part of the inner wall of the first case part which forms the discharge path is C, and a gap between an upper end of the first carrying member and an upper surface of the part of the inner wall of the first case part which forms the discharge path is D, a relationship of C>D may be satisfied.

A magnet for attracting the developer may be installed inside the developing roller, and the developing apparatus may further include a developer staying member installed at a location between a counter blade-side end portion of the magnet and the counter blade in an extending direction of the first carrying member to make the developer stay in place.

The developer staying member may include a magnetic substance and may be installed inside the first case part.

The first carrying member may further include a support shaft having the carrying blade installed on an outer circumferential surface thereof, a large diameter part having a large outer diameter may be prepared at the location between the counter blade-side end portion of the magnet and the counter blade on the support shaft, and the developer staying member may be implemented by the large diameter part.

The carrying blade may include a small diameter part having a small outer diameter at the location between the counter blade-side end portion of the magnet and the counter blade, and the developer staying member may be implemented by the small diameter part.

The first carrying member may further include a support shaft having the carrying blade installed on an outer circumferential surface thereof, the support shaft may include a carrying blade non-installation part, on which the carrying blade is not installed, at the location between the counter blade-side end portion of the magnet and the counter blade, and the developer staying member may be implemented by the carrying blade non-installation part.

The first carrying member may further include a support shaft, the carrying blade may be formed in a spiral shape on an outer circumferential surface of the support shaft along an axial line direction of the support shaft, the carrying blade may include a small gap part having a narrow gap between adjacent portions of the carrying blade in the axial line direction of the support shaft at the location between the counter blade-side end portion of the magnet and the counter blade, and the developer staying member may be implemented by the small gap part.

The developing apparatus may further include a magnet located on the discharge path to make the developer stay in place by a magnet force.

The developing apparatus may further include a developer staying member located at a location facing the magnet to make the developer stay in place.

The first carrying member may further include a support shaft having the carrying blade installed on an outer circumferential surface thereof, when a part of the support shaft facing the magnet is a first part, a part of the support shaft closer to the first opening part than the first part is a second part, a gap between an upper surface of a part of the inner wall of the first case part which covers the first part and the first part is E, and a gap between an upper surface of a part of the inner wall of the first case part which covers the second part and the second part is F, a relationship of E<F may be satisfied, and the developer staying member may be implemented by the part of the inner wall of the first case part, which covers the first part, and the first part.

The first carrying member may further include: a support shaft having the carrying blade installed in a spiral shape on an outer circumferential surface thereof; and a paddle member installed at a location facing the magnet to connect adjacent portions of the carrying blade in an axial direction of the support shaft, and the developer staying member may be implemented by the paddle member.

The first carrying member may further include a support shaft having the carrying blade installed on an outer circumferential surface thereof, and the magnet may have a region overlapping the counter blade when viewing the magnet in an axial direction of the support shaft.

The carrying blade may include an upstream side carrying blade and a downstream side carrying blade respectively located at a second opening part side and a developer discharge hole side by interposing the counter blade therebetween, a gap may be prepared between an upper part of the counter blade and the inner wall of the first case part covering the counter blade, and the magnet may be installed between the counter blade and the downstream side carrying blade.

According to an aspect of another embodiment, a developing apparatus includes: first and second case parts; first and second opening parts for allowing the first and second case parts to communicate with each other; a developing roller installed in the first case part; a first carrying member installed in the first case part to carry, towards the first opening part, developer introduced from the second case part through the second opening part and to supply the developer to the developing roller; a second carrying member installed in the second case part to carry, towards the second opening part, the developer introduced from the first case part through the first opening part; a developer discharge hole provided in the first case part at an opposite side to the second opening part; and a developer staying member for making the developer being carried towards the developer discharge hole by the first carrying member stay in place by a magnetic force.

The first carrying member may include: a carrying blade for carrying the developer towards the first opening part; and a counter blade located between the first opening part and the developer discharge hole to carry the developer towards the first opening part, and a cross-sectional area of a discharge path for the developer from the counter blade to the developer discharge hole within the first case part may be less at a developer discharge hole side than at a counter blade side.

Advantageous Effects of the Invention

According to the present invention, a developing apparatus capable of suppressing an excessive discharge of developer through a developer discharge hole may be provided.

MODE OF THE INVENTION

Figure 1:
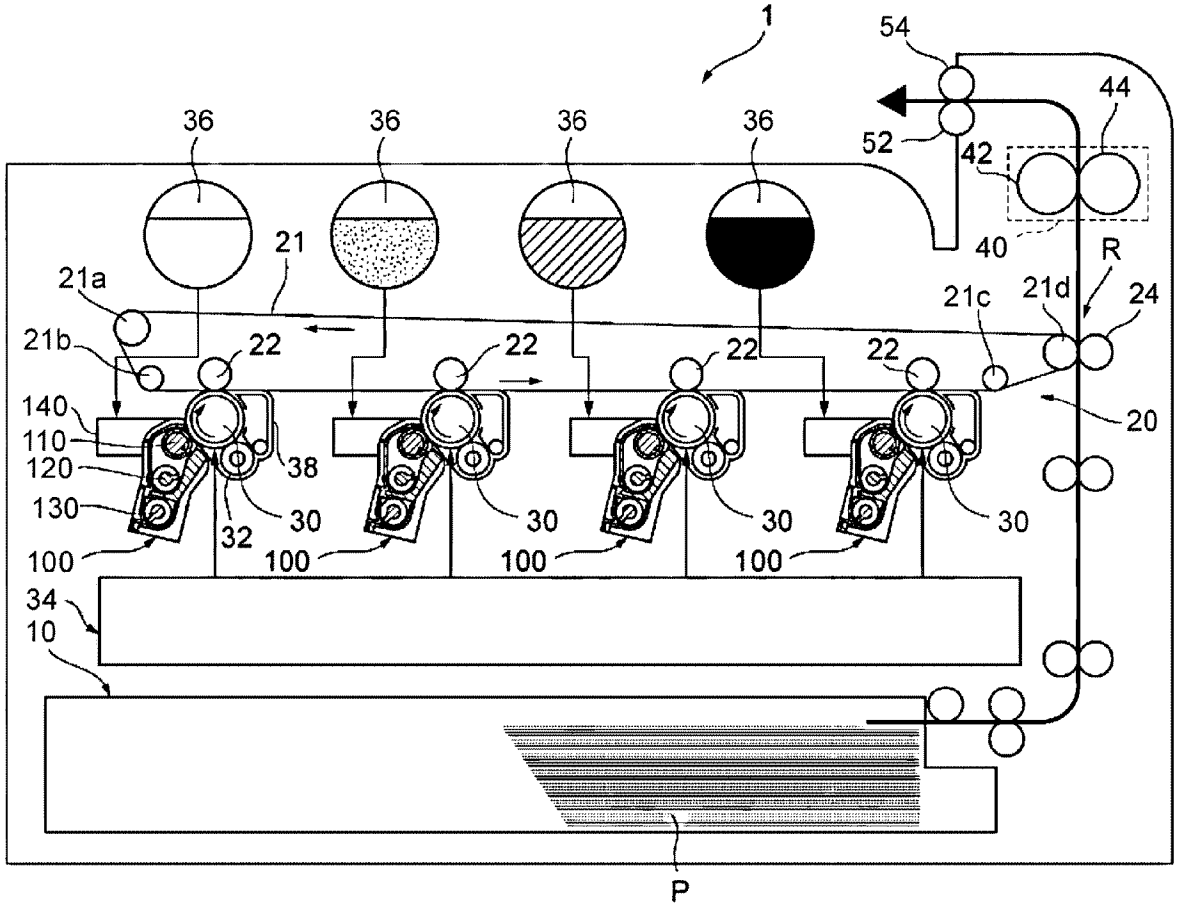
FIG. 1 illustrates a schematic configuration of an image forming apparatus according to first and second embodiments.

A developing apparatus, according to the present invention, includes a first carrying member, a second carrying member, a first case part, and a second case part. The first carrying member stirs and carries developer by using a carrying blade and supplies the developer to a developing roller. The second carrying member is arranged to be parallel to the first carrying member and stirs and carries the developer in an opposite direction to the first carrying member. The first case part accommodates the first carrying member. The second case part accommodates the second carrying member. The first case part includes a first opening part, a second opening part, and a developer discharge hole. The developer is carried from the inside of the first case part to the inside of the second case part through the first opening part. The developer is carried from the inside of the second case part to the inside of the first case part through the second opening part. The developer is discharged from the first case part through the developer discharge hole. The developer discharge hole is prepared at a location of a one-end side of the first carrying member. The second opening part is prepared at a location of the other-end side of the first carrying member. The first opening part is prepared at a location between the second opening part and the developer discharge hole. The first carrying member includes a counter blade installed at a location between the first opening part and the developer discharge hole. The carrying blade of the first carrying member carries the developer from a second opening part side towards the developer discharge hole. The counter blade carries the developer in an opposite direction to a carrying direction of the carrying blade of the first carrying member. A gap is prepared between an upper part of the counter blade and an inner wall of the first case part which covers the counter blade. A cross-sectional area of a developer discharge path from the counter blade to the developer discharge hole within the first case part is changed according to a progress of the developer along the discharge path.

In the developing apparatus, the carrying blade of the first carrying member carries the developer from the second opening part side towards the first opening part side. The second carrying member carries the developer from the first opening part side towards the second opening part side. The counter blade carries the developer from the developer discharge hole side towards the first opening part side. Accordingly, the developer circulates between the inside of the first case part and the inside of the second case part. When an amount of the developer inside the first case part is increased, the developer passes over the counter blade and moves from the first opening part side towards the developer discharge hole side. The developer which has passed over the counter blade is discharged through the developer discharge hole. Herein, the cross-sectional area of the developer discharge path from the counter blade to the developer discharge hole is changed according to a progress of the developer along the discharge path. Therefore, at a portion where the cross-sectional area is changed, a flow direction of air flowing from the counter blade to the developer discharge hole is changed, thereby scattering the flow of the air. That is, the flow of the air flowing towards the developer discharge hole is suppressed. Therefore, an unintentional discharge of the developer through the developer discharge hole along the flow of the air is suppressed. Accordingly, an excessive discharge of the developer from the developing apparatus may be suppressed.

The cross-sectional area of the discharge path may be stepwise decreased towards the developer discharge hole. In this case, at a portion where the cross-sectional area of the discharge path is changed, the flow direction of the air flowing towards the developer discharge hole is changed significantly, thereby disturbing the flow of the air. The change of the flow direction of the air may cause the developer to be separated from the flow of the air. In addition, the discharge path is narrowed towards the developer discharge hole. Accordingly, the flow of the air is disturbed towards the developer discharge hole. Therefore, the excessive discharge of the developer from the developing apparatus may be further suppressed.

The discharge path may include a first path part and a second path part. The second path part may be adjacent to the first path part and located closer to the developer discharge hole side than the first path part. A cross-sectional area of a part of the first carrying member located on the first path part is assumed as A. A cross-sectional area of the second path part is assumed as B. In this case, a relationship of A>B may be satisfied. In this case, a linear flow of the air may be suppressed when the air flows from the first path part to the second path part. That is, a stepped portion between the first path part and the second path part functions as a wall for disturbing the flow of the air. Accordingly, the flow of the air flowing towards the developer discharge hole may be further suppressed. Therefore, the excessive discharge of the developer from the developing apparatus may be further suppressed.

The cross-sectional area of the discharge path may be continuously decreased towards the developer discharge hole. As such, the discharge path is narrowed towards the developer discharge hole. Accordingly, the flow of the air is disturbed towards the developer discharge hole. Therefore, the excessive discharge of the developer from the developing apparatus may be further suppressed.

A difference between the cross-sectional area of the discharge path and a cross-sectional area of the first carrying member may be decreased towards the developer discharge hole. In this case, a flow path of the air, which is formed between the inner wall of the first case part and the first carrying member, is narrowed towards the developer discharge hole. Accordingly, the flow of the air is disturbed towards the developer discharge hole. Therefore, the excessive discharge of the developer from the developing apparatus may be further suppressed.

In the discharge path, a gap between a lower end of the first carrying member and a lower surface of a part of the inner wall of the first case part which forms the discharge path is assumed as C. In the discharge path, a gap between an upper end of the first carrying member and an upper surface of the part of the inner wall of the first case part which forms the discharge path is assumed as D. In this case, a relationship of C>D may be satisfied. Herein, in the discharge path for the developer, when the inner wall of the first case part and the first carrying member are in contact with each other by interposing the developer therebetween, a developer agglomerate may occur. Because of this, a gap between the inner wall and the first carrying member is narrowed at an upper portion of the discharge path where the developer is not collected. Accordingly, the flow of the air flowing towards the developer discharge hole may be suppressed while suppressing the occurrence of the developer agglomerate. Therefore, the excessive discharge of the developer from the developing apparatus may be further suppressed.

A magnet for attracting the developer may be installed inside the developing roller. The developing apparatus may further include a developer staying member at a location between a counter blade-side end portion of the magnet and the counter blade in an extending direction of the first carrying member. The developer staying member may make the developer stay in place. In this case, the developer stays at a location between the counter blade-side end portion of the magnet and the counter blade by the developer staying member. By making the developer stay at the location, the flow of the air flowing towards the developer discharge hole is suppressed. Therefore, the excessive discharge of the developer from the developing apparatus may be further suppressed. In addition, by installing the developer staying member at the location between the counter blade-side end portion of the magnet and the counter blade, an influence of the developer staying member on image formation by the developing roller may be suppressed.

The developer staying member may be a magnetic substance and may be installed inside the first case part. In this case, the developer staying member, which is a magnetic substance, may cause the developer to easily stay in place.

The first carrying member may further include a support shaft having the carrying blade installed on an outer circumferential surface of the support shaft. The support shaft may include a large diameter part having a large outer diameter at the location between the counter blade-side end portion of the magnet and the counter blade. The developer staying member may be implemented by the large diameter part. In this case, a carrying ability of the developer is lowered at a portion where the large diameter part is installed. That is, the developer stays in place due to the large diameter part. As such, the developer may easily stay in place by the large diameter part of the support shaft.

The first carrying member may include a small diameter part having a small outer diameter at the location between the counter blade-side end portion of the magnet and the counter blade. The developer staying member may be implemented by the small diameter part. In this case, a carrying ability of the developer is lowered at a portion where the small diameter part is installed. That is, the developer stays in place due to the small diameter part. As such, the developer may easily stay in place due to the small diameter part of the first carrying member.

The first carrying member may further include a support shaft having the carrying blade installed on an outer circumferential surface thereof, and the support shaft may include a carrying blade non-installation part, on which the carrying blade is not installed, at the location between the counter blade-side end portion of the magnet and the counter blade. The developer staying member may be implemented by the carrying blade non-installation part. In this case, a carrying ability of the developer is lowered at the carrying blade non-installation part on which the carrying blade is not installed. That is, the developer stays at the carrying blade non-installation part. As such, the developer may easily stay in place due to the carrying blade not being installed.

The first carrying member may further include a support shaft. The carrying blade may be installed in a spiral shape on an outer circumferential surface of the support shaft along an axial line direction of the support shaft. The carrying blade may include a small gap part at the location between the counter blade-side end portion of the magnet and the counter blade. The small gap part may be formed by narrowing a gap between adjacent portions of the carrying blade in the axial line direction of the support shaft. The developer staying member may be implemented by the small gap part. In this case, a carrying speed of the developer is lowered at the small gap part where a gap between adjacent portions of the carrying blade is narrowed. That is, the developer stays at the small gap part. As such, the developer may easily stay at the small gap part where a gap between adjacent portions of the carrying blade is narrowed.

A developing apparatus, according to the present invention, includes a first carrying member, a second carrying member, a first case part, and a second case part. The first carrying member stirs and carries a developer by using a carrying blade and supplies the developer to a developing roller. The second carrying member is arranged to be parallel to the first carrying member and stirs and carries the developer in an opposite direction to the first carrying member. The first case part accommodates the first carrying member. The second case part accommodates the second carrying member. The first case part includes a first opening part, a second opening part, and a developer discharge hole. The developer is carried from an inside of the first case part to an inside of the second case part through the first opening part. The developer is carried from the inside of the second case part to the inside of the first case part through the second opening part. The developer is discharged from the inside of the first case part through the developer discharge hole. The developer discharge hole is prepared at a location of a one-end side of the first carrying member. The second opening part is prepared at a location of the other-end side of the first carrying member. The first opening part is prepared at a location between the second opening part and the developer discharge hole. The first carrying member includes a counter blade installed at a location between the first opening part and the developer discharge hole. The carrying blade of the first carrying member carries the developer from the second opening part side towards the developer discharge hole. The counter blade carries the developer in an opposite direction to a carrying direction of the carrying blade of the first carrying member. A gap is prepared between an upper part of the counter blade and an inner wall of the first case part which covers the counter blade. A magnet is installed between the counter blade and the developer discharge hole. The magnet generates a magnetic field along a discharge path for the developer from the counter blade to the developer discharge hole.

In the developing apparatus, the carrying blade of the first carrying member carries the developer from the second opening part side towards the first opening part. The second carrying member carries the developer from the first opening part side towards the second opening part. The counter blade carries the developer from the developer discharge hole side towards the first opening part. Accordingly, the developer circulates between the inside of the first case part and the inside of the second case part. When an amount of the developer inside the first case part is increased, the developer passes over the counter blade and moves from the first opening part side towards the developer discharge hole. The developer which has passed over the counter blade is discharged to the outside of the first case part through the developer discharge hole. Herein, the magnet is installed between the counter blade and the developer discharge hole. The magnet generates a magnetic field to the discharge path for the developer. The magnet holds the developer by a magnetic force and makes the developer stay within the discharge path. As such, by making the developer stay in place, a path for the developer moving towards the developer discharge hole is narrowed, thereby suppressing the flow of the air flowing towards the developer discharge hole. Therefore, the excessive discharge of the developer from the developing apparatus may be suppressed.

The magnet installed between the counter blade and the developer discharge hole may be a multi-pole magnetization type. In addition, N-poles and S-poles of the magnet may be alternately arranged along a discharge direction of the developer in the discharge path. In this case, the developer stays in a band shape due to an influence of a line of magnetic force generated between an adjacent N-pole and S-pole. In addition, this band of the staying developer extends along a direction crossing (orthogonal to) the discharge direction of the developer. A plurality of N-poles and S-poles are installed alternately, and thus a plurality of bands of the developer are formed along the discharge direction of the developer. Therefore, the flow of the air flowing towards the developer discharge hole is suppressed by the formed plurality of bands of the developer. Therefore, the excessive discharge of the developer from the developing apparatus may be further suppressed.

The developing apparatus may further include a developer staying member for making the developer stay at a location facing the magnet in the discharge path. In this case, the developer stays at the location facing the magnet due to the developer staying member. By making the developer stay in place, the flow of the air flowing towards the developer discharge hole is suppressed. Therefore, the excessive discharge of the developer from the developing apparatus may be further suppressed.

In the apparatus, the first carrying member may further include a support shaft having the carrying blade installed on an outer circumferential surface thereof. Herein, a part of the support shaft facing the magnet is a first part. A part of the support shaft closer to the first opening part than the first part is a second part. A gap between an upper surface of a part of the inner wall of the first case part which covers the first part and the first part is E. A gap between an upper surface of a part of the inner wall of the first case part which covers the second part and the second part is F. In this case, a relationship of $E<F$ may be satisfied. The developer staying member may be implemented by the part of the inner wall of the first case part, which covers the first part, and the first part. A gap between the inner wall of the first case part and the support shaft is narrowed as a portion facing the magnet. As such, a developer passage is narrowed at the portion facing the magnet, and thus a lot of developer may be held by the magnet. That is, since the developer moving towards the developer discharge hole may be further stayed in place, the flow of the air flowing towards the developer discharge hole is suppressed. Therefore, the excessive discharge of the developer from the developing apparatus may be further suppressed.

The first carrying member may further include a support shaft and a paddle member. The carrying blade may be installed in a spiral shape on an outer circumferential surface of the support shaft. The paddle member may be installed at a location facing the magnet. The paddle member may connect adjacent portions of the carrying blade in an axial direction of the support shaft. The developer staying member may be implemented by the paddle member. When rotating the support shaft, the paddle member pushes the developer in a direction away from the support shaft. That is, the paddle member pushes the developer towards the magnet. Accordingly, an amount of the developer held by the magnet is increased, and the flow of the air flowing towards the developer discharge hole is suppressed. Therefore, the excessive discharge of the developer from the developing apparatus may be further suppressed.

A developing apparatus includes a first carrying member, a second carrying member, a first case part, and a second case part. The first carrying member stirs and carries a developer by a carrying blade and supplies the developer to a developing roller. The second carrying member is arranged to be parallel to the first carrying member and stirs and carries the developer in an opposite direction to the first carrying member. The first case part accommodates the first carrying member. The second case part accommodates the second carrying member. The first case part includes a first opening part, a second opening part, and a developer discharge hole. The developer is carried from an inside of the first case part to an inside of the second case part through the first opening part. The developer is carried from the inside of the second case part to the inside of the first case part through the second opening part. The developer is discharged from the first case part through the developer discharge hole. The developer discharge hole is prepared at the location of a one-end side of the first carrying member. The second opening part is prepared at the location of the other-end side of the first carrying member. The first opening part is prepared at the location between the second opening part and the developer discharge hole. The first carrying member includes a counter blade and further includes a support shaft having the carrying blade and the counter blade installed on an output circumferential surface thereof. The counter blade is installed at a location between the first opening part and the developer discharge hole. The carrying blade of the first carrying member includes an upstream side carrying blade and a downstream side carrying blade. The upstream side carrying blade is installed closer to the second opening part side than the counter blade. The downstream side carrying blade is installed closer to the developer discharge hole side than the counter blade. The upstream side carrying blade and the downstream side carrying blade carry the developer from the second opening part side towards the developer discharge hole. The counter blade carries the developer in an opposite direction to a carrying direction of the upstream side carrying blade and the downstream side carrying blade. A gap is prepared between an upper part of the counter blade and the inner wall of the first case part which covers the counter blade. A magnet is installed between the counter blade and the downstream side carrying blade. The magnet has a region overlapping the counter blade when viewing the magnet in an axial direction of the support shaft of the first carrying member.

In the developing apparatus, the carrying blade of the first carrying member carries the developer from the second opening part side towards the first opening part. The second carrying member carries the developer from the first opening part side towards the second opening part. The counter blade carries the developer from the developer discharge hole side towards the first opening part. Accordingly, the developer circulates between the inside of the first case part and the inside of the second case part. When an amount of the developer inside the first case part is increased, the developer passes over the counter blade and moves from the first opening part side towards the developer discharge hole. The developer which has passed over the counter blade is discharged to the outside of the first case part through the developer discharge hole. Herein, a magnet is installed between the counter blade and the downstream side carrying blade. The magnet generates a magnetic field to a discharge path for the developer. The magnet holds the developer by a magnetic force and makes the developer stay within the discharge path. As such, by making the developer stay in place, the flow of the air flowing towards the developer discharge hole is suppressed. Therefore, the excessive discharge of the developer from the developing apparatus may be suppressed. In addition, a portion of the developer staying by the magnet is carried back towards the first opening part by the counter blade. Accordingly, the developing apparatus may make the developer stay in place by the magnet while carrying a surplus developer, which stays in place by the magnet, towards the first opening part.

The magnet installed between the counter blade and the downstream side carrying blade may be a double-sided magnetization type. An N-pole of the magnet may orient towards the counter blade, and an S-pole may orient towards the downstream side carrying blade. Alternatively, the N-pole of the magnet may orient towards the downstream side carrying blade, and the S-pole may orient towards the counter blade. In this case, the developer stays in a band shape due to an influence of a line of magnetic force generated between the N-pole and S-pole of the magnet. In addition, this band of the staying developer extends along a direction crossing (orthogonal) to the discharge direction of the developer. Therefore, the flow of the air flowing towards the developer discharge hole is suppressed by the band of the staying developer. Therefore, the excessive discharge of the developer from the developing apparatus may be further suppressed.

Hereinafter, embodiments of an image forming apparatus employing the developing apparatus according to the present invention will be described with reference to the drawings. In addition, like reference numerals in the drawings denote like elements, and thus their repetitive description will be omitted.

(First Embodiment)

(Overall Configuration of Image Forming Apparatus)

First, a first embodiment is described. As shown in FIG. 1, an image forming apparatus 1 includes a recording medium feeding unit 10, a transfer unit 20, photoreceptor drums 30, four developing units (developing apparatuses) 100, and a fixing unit 40.

The recording medium feeding unit 10 accommodates paper P as a recording medium on which an image is to be finally formed. In addition, the recording medium feeding unit 10 feeds the paper P on a recording medium feeding path. The paper P is stacked in a cassette. The recording medium feeding unit 10 feeds the paper P to arrive at a secondary transfer region R at a timing a toner image to be transferred to the paper P arrives as the secondary transfer region R.

The transfer unit 20 conveys a toner image formed by the developing units 100 to the secondary transfer region R where the toner image is to be secondarily transferred to the paper P. The transfer unit 20 includes a transfer belt 21, suspending rollers 21*a*, 21*b*, 21*c*, and 21*d*, primary transfer rollers 22 interposing the transfer belt 21 with the photoreceptor drums 30, and a secondary transfer roller 24 interposing the transfer belt 21 with the suspending roller 21*d*.

The transfer belt 21 is an endless belt circularly moving by the suspending rollers 21*a*, 21*b*, 21*c*, and 21*d*. The primary transfer rollers 22 are installed so as to press the photoreceptor drums 30 from an inner circumferential side of the transfer belt 21. The secondary transfer roller 24 is installed so as to press the suspending roller 21*d* from an outer circumferential side of the transfer belt 21. In addition, the transfer unit 20 may further include a belt cleaning device for removing toner attached to the transfer belt 21, and the like.

The photoreceptor drum 30 is an electrostatic latent image carrier having an image formed on an outer circumferential surface. The photoreceptor drum 30 may include, for example, an organic photoconductor (OPC). The image forming apparatus 1 according to the present embodiment may form a color image. According to the image forming apparatus 1, four photoreceptor drums 30 respectively corresponding to, for example, magenta, yellow, cyan, and black are installed along a moving direction of the transfer belt 21. Around each of the photoreceptor drums 30, electrifying charging roller 32, an exposure unit 34, the developing unit 100, and a cleaning unit 38 are installed as shown in FIG. 1.

The charging roller 32 uniformly charges the surface of the photoreceptor drum 30 at a predetermined electric potential. The exposure unit 34 exposes, to the light, the surface of the photoreceptor drum 30, which has been charged by the charging roller 32, according to an image to be formed on the paper P. Accordingly, an electric potential of a portion of the surface of the photoreceptor drums 30, which is exposed to the light by the exposure unit 34, is changed, thereby forming an electroctatic latent image. Toner is supplied to the four developing units 100 from toner tanks 36 respectively installed in correspondence to the developing units 100. The developing unit 100 generates a toner image by using the toner to develop the electroctatic latent image formed on the photoreceptor drum 30. A developer for supply, in which a carrier is mixed with each of magenta, yellow, cyan, and black toner, is filled in each of the four toner tanks 36.

The cleaning unit 38 collects toner remaining on the photoreceptor drum 30 after the toner image formed on the photoreceptor drum 30 was primarily transferred to the transfer belt 21. As the cleaning unit 38, for example, a configuration of removing remaining toner on the photoreceptor drum 30 by making a cleaning blade be in contact with the outer circumferential surface of the photoreceptor drum 30 may be employed. In addition, a charge eliminating lamp for resetting an electric potential of the photoreceptor drum 30 may be arranged on the outer circumferential surface of the photoreceptor drum 30 and between the cleaning unit 38 and the charging roller 32 in a rotating direction of the photoreceptor drum 30.

The fixing unit 40 attaches and fixes the toner image, which is secondarily transferred from the transfer belt 21 to the paper P, to the paper P. The fixing unit 40 may include, for example, a heating roller 42 and a pressing roller 44. The heating roller 42 is a cylindrical member capable of rotating around a rotary shaft. In the inside of the heating roller 42, a heat source, for example, a halogen lamp, is installed. The pressing roller 44 is a cylindrical member capable of rotating around a rotary shaft. The pressing roller 44 is installed to press the heating roller 42. A heat-resistant elastic layer, for example, silicon rubber, is installed on outer circumferential surfaces of the heating roller 42 and the pressing roller 44.

The toner image is melted and fixed to the paper P by passing the paper P through a fixing nip part which is a contact region between the heating roller 42 and the pressing roller 44.

In addition, in the image forming apparatus 1, discharge rollers 52 and 54 for discharging, to the outside of the image forming apparatus 1, the paper P on which the toner image has been fixed by the fixing unit 40.

Next, an operation of the image forming apparatus 1 is described. An image signal of an image to be recorded is input to the image forming apparatus 1. A control unit of the image forming apparatus 1 uniformly charges the surface of the photoreceptor drum 30 at a predetermined electric potential by using the charging roller 32 according to the received image signal. Thereafter, the control unit of the image forming apparatus 1 forms an electrostatic latent image by scanning laser light on the surface of the photoreceptor drum 30 by using the exposure unit 34.

The developing unit 100 adjusts toner and a carrier to obtain a desired mixture ratio and mixes and stirs the toner and the carrier. Accordingly, the developing unit 100 adjusts a developer so as the toner to be uniformly distributed and to have an optimal quantity of electric charge. The developer is carried to a developing roller 110. Thereafter, when the developer is carried to a region facing the photoreceptor drum 30 by rotation of the developing roller 110, the toner of the developer carried to the developing roller 110 moves to the electrostatic latent image formed on the outer circumferential surface of the photoreceptor drum 30, thereby developing the electrostatic latent image. A toner image formed as described above is primarily transferred from the photoreceptor drum 30 to the transfer belt 21 in a region in which the photoreceptor drum 30 faces the transfer belt 21. A single stacked toner image is formed on the transfer belt 21 by sequentially stacking toner images formed on the four photoreceptor drums 30. Thereafter, the stacked toner image is secondarily transferred to the paper P fed from the recording medium feeding unit 10, in a secondary transfer region R in which the suspending roller 21*d* faces the secondary transfer roller 24.

The paper P to which the stacked toner image has been secondarily transferred is conveyed to the fixing unit 40. The stacked toner image is melted and fixed to the paper P by passing the paper P between the heating roller 42 and the pressing roller 44 while applying heat and pressure. Thereafter, the paper P is discharged to the outside of the image forming apparatus 1 by the discharge rollers 52 and 54. When a belt cleaning device is prepared, toner remaining on the transfer belt 21 after the stacked toner image was secondarily transferred to the paper P is removed by the belt cleaning device.

(Configuration of Developing Unit)

Figure 2:
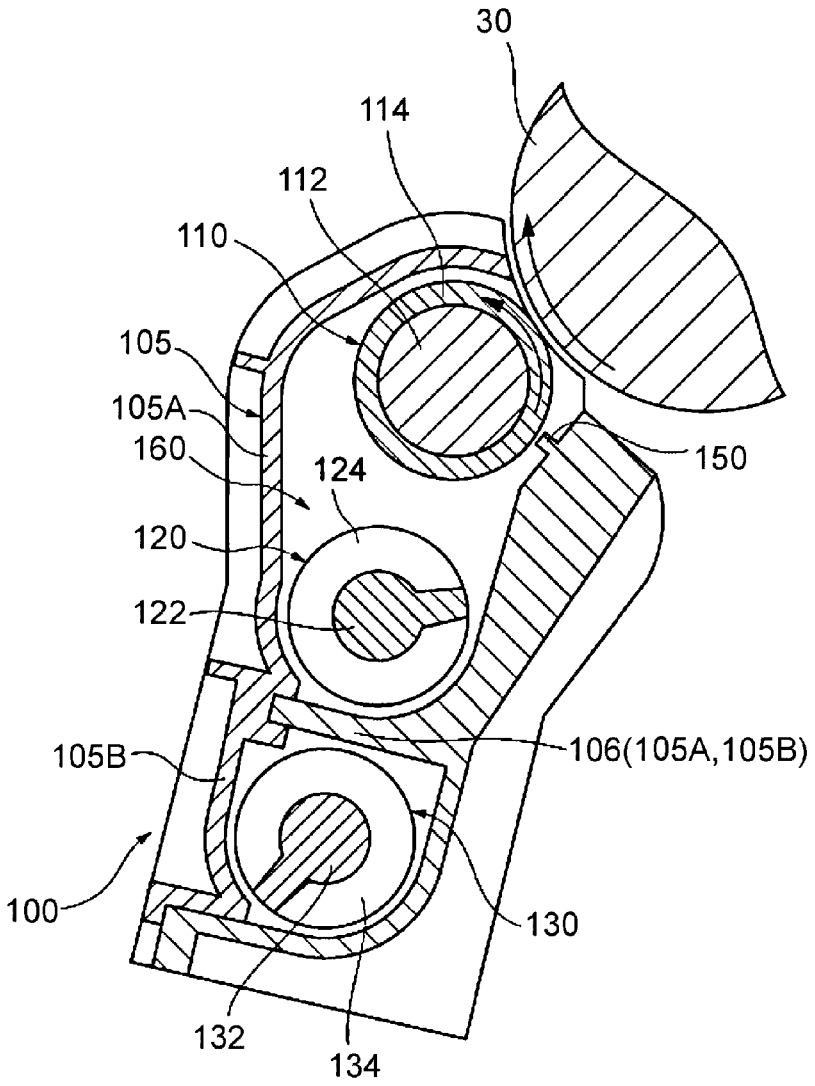
FIG. 2 is a cross-sectional view of a developing unit of FIG. 1 in a vertical direction.
Figure 3:
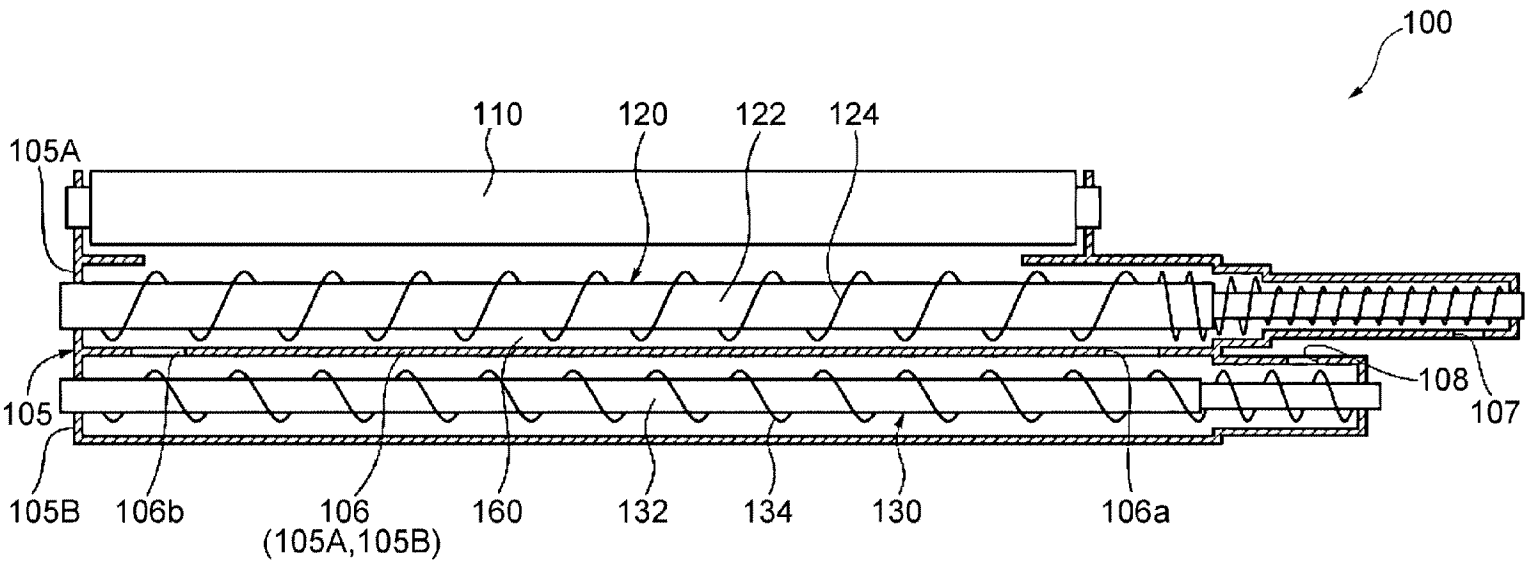
FIG. 3 is a cross-sectional view illustrating a schematic configuration of the developing unit according to the first embodiment.

As shown in FIGS. 2 and 3, the developing unit 100 includes the developing roller 110, a first carrying member 120, and a second carrying member 130. The developing roller 110, the first carrying member 120, and the second carrying member 130 are installed in a developer accommodation space 160 formed by a case 105 of the developing unit 100.

The developing roller 110 is a developer carrier for supplying toner to an electrostatic latent image formed on the outer circumferential surface of the photoreceptor drum 30. The developing roller 110 includes, for example, a developing sleeve 114 and a magnet 112 arranged inside the developing sleeve 114. The developing sleeve 114 is a cylindrical member formed of a non-magnetic metal. In the developing roller 110, only the developing sleeve 114 rotates. The magnet 112 arranged inside the developing sleeve 114 is fixed to the case 105.

The magnet 112 has a plurality of magnetic poles. The magnet 112 may have a shape in which different magnetic poles are alternately arranged in a region facing the photoreceptor drum 30. The region facing the photoreceptor drum 30 is a region from a developing region in which the electrostatic latent image formed on the photoreceptor drum 30 is developed to a region facing the first carrying member 120. The magnet 112 carries the developer on the developing sleeve 114 by a magnetic force. In addition, in the developing region, brushes of a magnetic brush of the developer are erected to make a corresponding magnetic brush be in contact with or approach the electrostatic latent image on the photoreceptor drum 30. Because of this, a pole position or interpole position is arranged in the developing region. In addition, magnetic poles having the same polarity are closely arranged in a circumferential direction at a location where the developing roller 110 faces the first carrying member 120. Due to the magnetic poles having the same polarity, a magnetic force in a tangential direction and a normal direction with respect to a rotating direction of the developing sleeve 114 is low at an interpole position. Accordingly, the developer is separated from the developing sleeve 114 at the location where the developing roller 110 faces to the first carrying member 120, according to the rotation of the developing sleeve 114.

In addition, a layer thickness regulating member 150 is installed at an upstream side of the rotating direction of the developing sleeve 114 based on a location where the developing sleeve 114 of the developing roller 110 faces the photoreceptor drum 30. The layer thickness regulating member 150 is a member for regulating the developer attached onto the outer circumferential surface of the developing sleeve 114 as a layer having a uniform thickness. As the layer thickness regulating member 150, for example, a blade made of a metal may be used.

When the developing roller 110 rotates, the air may be introduced into the inside of the developer accommodation space 160. In this case, pressure inside the case 105 increases. To release the pressure inside the case 105, a hole for releasing pressure may be prepared in the case 105. A filter may be installed in the hole for lowering pressure so as not to discharge the developer.

The first carrying member 120 and the second carrying member 130 stir a magnetic carrier and non-magnetic toner constituting the developer inside the developer accommodation space 160 to make the carrier and toner rubbed and charged.

The case 105 includes a first case part 105A and a second case part 105B. The first case part 105A accommodates the developing roller 110 and the first carrying member 120. The second case part 105B accommodates the second carrying member 130.

The first carrying member 120 is arranged to face the developing roller 110 at a lower side of the developing roller 110 in an approximately vertical direction. The first carrying member 120 supplies the mixed and stirred developer to the developing roller 110. The first carrying member 120 includes a first support shaft 122 and a first carrying blade (carrying blade) 124. The first support shaft 122 is rotatably supported by the first case part 105A through a bearing (not shown). The first support shaft 122 extends along an approximately horizontal direction. The first carrying blade 124 is installed on an outer circumferential surface of the first support shaft 122. The first carrying blade 124 has a spiral-shaped inclined surface arranged along a lengthwise direction of the first support shaft 122.

The second carrying member 130 is arranged a lower side of the first carrying member 120 in an approximately vertical direction. The second carrying member 130 functions to sufficiently charge the developer by mixing and stirring the developer. The second carrying member 130 carries the charged developer to the first carrying member 120. Like the first carrying member 120, the second carrying member 130 includes a second support shaft 132 and a second carrying blade 134. The second support shaft 132 is rotatably supported by the second case part 105B through a bearing (not shown). The second support shaft 132 extends along a horizontal direction. The second carrying blade 134 is installed on an outer circumferential surface of the second support shaft 132. The second carrying blade 134 has a spiral-shaped inclined surface arranged along a lengthwise direction of the second support shaft 132.

The first carrying member 120 and the second carrying member 130 are arranged side by side such that the first support shaft 122 and the second support shaft 132 are approximately parallel to each other. The first case part 105A and the second case part 105B are installed to be adjacent in an approximately vertical direction. According to the present embodiment, a lower portion of the first case part 105A and an upper portion of the second case part 105B are formed by a single member (hereinafter, referred to as "partitioning plate 106"). That is, the partitioning plate 106 also functions as a portion of the first case part 105A and a portion of the second case part 105B. The partitioning plate 106 separates the first carrying member 120 from the second carrying member 130. The partitioning plate 106 includes a first opening part 106*a* and a second opening part 106*b*.

The developer moves from the inside of the first case part 105A to the inside of the second case part 105B through the first opening part 106*a*. The developer moves from the second case part 105B to the first case part 105A through the second opening part 106*b*. The first carrying member 120 carries, towards the first opening part 106*a*, the developer introduced from the second case part 105B to the first case part 105A through the second opening part 106*b*. The second carrying member 130 carries, towards the second opening part 106*b*, the developer introduced to the second case part 105B through the first opening part 106*a*.

The developer stirred and carried by the second carrying member 130 inside the second case part 105B is carried to the inside of the first case part 105A through the second opening part 106*b*. The first carrying blade 124 of the first carrying member 120 stirs and carries the developer from a side of the second opening part 106*b* towards the first opening part 106*a*. While carrying the developer by the first carrying member 120, a portion of developer moves to an outer circumferential surface of the developing roller 110. The developer which has not moved to the outer circumferential surface of the developing roller 110 is carried to the inside of the second case part 105B through the first opening part 106*a*.

In the second case part 105B, a toner supply hole 108 is prepared. For example, a toner concentration sensor (not shown) for detecting a toner concentration inside the developer accommodation space 160 is installed near the second carrying member 130. When the toner concentration inside the developer accommodation space 160 is decreased, a developer for supply is supplied from a toner tank 36 to the inside of the second case part 105B through a developer supply unit 140 (see FIG. 1) and the toner supply hole 108.

Figure 4:
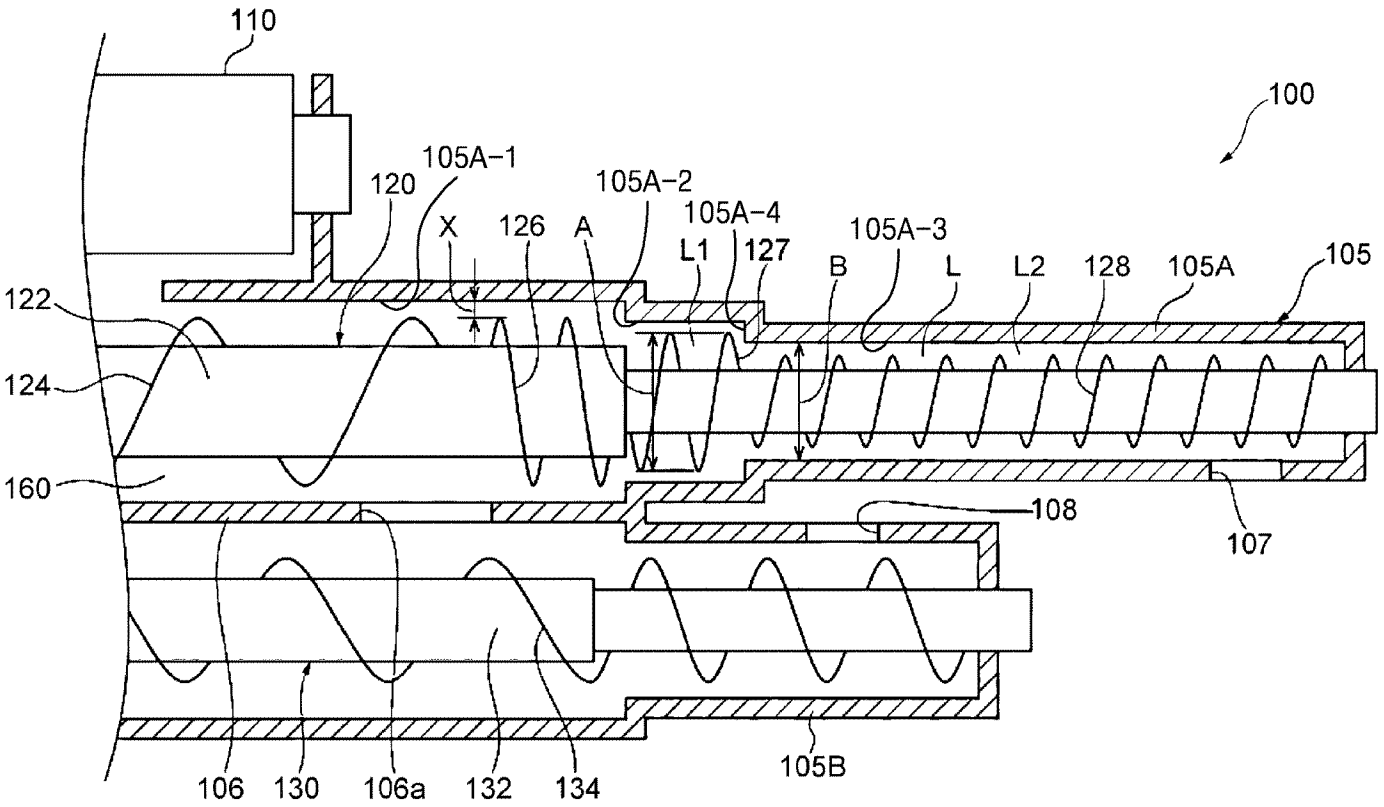
FIG. 4 is a cross-sectional view illustrating a schematic configuration of the surroundings of a discharge path of the developing unit.

In the first case part 105A, a developer discharge hole 107 is prepared. The developer deteriorated due to a printing operation is discharged through the developer discharge hole 107 by a change in a volume of the developer inside the developer accommodation space 160. Hereinafter, a configuration around the developer discharge hole 107 is described with reference to FIG. 4.

The developer discharge hole 107 is prepared at a location of a one-end side of the first carrying member 120. The second opening part 106*b* (see FIG. 3) is prepared at a location of the other-side of the first carrying member 120. The first opening part 106*a* is prepared at a location between the second opening part 106*b* and the developer discharge hole 107.

The first carrying member 120 may further include a counter blade 126, a first discharge blade 127, and a second discharge blade 128. The counter blade 126 is installed at a location between the first opening part 106*a* and the developer discharge hole 107. The counter blade 126 is installed on the outer circumferential surface of the first support shaft 122. The counter blade 126 has a spiral-shaped inclined surface arranged along a lengthwise direction of the first support shaft 122.

The counter blade 126 carries the developer in an opposite direction to a carrying direction of the first carrying blade 124. That is, the counter blade 126 carries back, towards the first opening part 106*a*, the developer moving from the first opening part 106*a* to the developer discharge hole 107. A gap X is prepared between an upper part of the counter blade 126 and an inner wall 105A-1 of the first case part 105A which covers the counter blade 126.

The first discharge blade 127 is installed closer to the developer discharge hole 107 than the counter blade 126. The first discharge blade 127 is installed on the outer circumferential surface of the first support shaft 122. The first discharge blade 127 has a spiral-shaped inclined surface arranged along a lengthwise direction of the first support shaft 122. The first discharge blade 127 carries the developer in the same direction as the first carrying blade 124. That is, the first discharge blade 127 carries the developer from the first opening part 106*a* towards the developer discharge hole 107.

The second discharge blade 128 is installed closer to the developer discharge hole 107 than the first discharge blade 127. The second discharge blade 128 is installed on the outer circumferential surface of the first support shaft 122. The second discharge blade 128 has a spiral-shaped inclined surface arranged along a lengthwise direction of the first support shaft 122. The second discharge blade 128 carries the developer in the same direction as the first carrying blade 124. That is, the second discharge blade 128 carries the developer from the first opening part 106*a* towards the developer discharge hole 107.

Herein, a path for the developer which passes over the counter blade 126 and moves towards the developer discharge hole 107 is referred to as a discharge path L. The discharge path L is formed by inner walls 105A-2 and 105A-3 of the first case part 105A which cover the first discharge blade 127 and the second discharge blade 128. A cross-section of the discharge path L may be a ring shape. However, the discharge path L is not limited to the cross-section of the ring shape. The discharge path L may include a first path part L1 and a second path part L2. The second path part L2 is adjacent to the first path part L1 and is located closer to the developer discharge hole 107 than the first path part L1.

A cross-sectional area of the discharge path L is changed from the counter blade 126 towards the developer discharge hole 107. In detail, the cross-sectional area of the discharge path L is stepwise decreased towards the developer discharge hole 107. Herein, the cross-sectional area of the discharge path L is an area of a surface orthogonal to a discharge direction of the developer. In addition, stepwise decreasing indicates that a cross-sectional area is changed by a stepped portion 105A-4 formed between the inner walls 105A-2 and 105A-3 of the first case part 105A. That is, a cross-sectional area of the first path part L1 is greater than that of the second path part L2. According to the present embodiment, the cross-sectional area of the discharge path L is changed only once, but the cross-sectional area of the discharge path L may be changed twice or more.

The first discharge blade 127 is located on the first path part L1. The second discharge blade 128 is located on the second path part L2. An outer diameter of the counter blade 126 is greater than that of the first discharge blade 127. An outer diameter of the first discharge blade 127 is greater than that of the second discharge blade 128. Herein, the counter blade 126, the first discharge blade 127, and the second discharge blade 128 are generally ring-shaped when viewing them along an extending direction of the first support shaft 122. However, a case in which the counter blade 126 or the like is not ring-shaped such as oval-shaped or protrusion-installed when viewing it along the extending direction of the first support shaft 122 may be considered. In this case, an outer diameter of the counter blade 126 or the like is a length of the widest portion, that is, the greatest outer diameter, when viewing the counter blade 126 or the like along the extending direction of the first support shaft 122.

A cross-sectional area of the first discharge blade 127 is assumed as A. A cross-sectional area of the second path part L2 is assumed as B. In this case, the cross-sectional area A and the cross-sectional area B may satisfy A>B. Likewise, a cross-sectional area of the counter blade 126 may be greater than or equal to that of the first path part L1. In addition, the cross-sectional area of the first discharge blade 127 is a projecting area when viewing the first discharge blade 127 along the extending direction of the first support shaft 122. The cross-sectional area of the counter blade 126 is also a projecting area as well as the first discharge blade 127.

In addition, a difference between the cross-sectional area of the discharge path L and a cross-sectional area of the first carrying member 120 may be decreased towards the developer discharge hole 107. In addition, the cross-sectional area of the first carrying member 120 is a projecting area when viewing the first carrying member 120 along the extending direction of the first support shaft 122. A gap between the inner wall 105A-2 of the first case part 105A which forms the first path part L1 and the first discharge blade 127 is greater than a gap between the inner wall 105A-3 of the first case part 105A which forms the second path part L2 and the second discharge blade 128. Likewise, the gap X between the inner wall 105A-1 of the first case part 105A and the counter blade 126 may be greater than the gap between the inner wall 105A-2 of the first case part 105A which forms the first path part L1 and the first discharge blade 127.

In addition, according to the present embodiment, the path in which the developer which has passed the counter blade 126 moves towards the developer discharge hole 107 is the discharge path L. However, the present embodiment is not limited thereto, and the discharge path L may further include a portion where the counter blade 126 is installed besides the first path part L1 and the second path part L2. In this case, the cross-sectional area of the discharge path L is changed at a location between the counter blade 126 and the first discharge blade 127, and the cross-sectional area of the discharge path L is also changed at a location between the first discharge blade 127 and the second discharge blade 128.

Next, a figure of discharging the developer from the developer discharge hole 107 is described. The counter blade 126 carries the developer back towards the first carrying blade 124 such that the developer inside the developer accommodation space 160 does not move towards the developer discharge hole 107. When an amount of the developer inside the developer accommodation space 160 is increased, the developer passes over the counter blade 126. The developer which has passed over the counter blade 126 is carried towards the developer discharge hole 107 in the discharge path L by the first discharge blade 127 and the second discharge blade 128. Thereafter, the developer is discharged to the outside of the case 105 through the developer discharge hole 107.

According to the present embodiment, when an amount of the developer inside the developer accommodation space 160 is increased, the developer moves from the first opening part 106*a* towards the developer discharge hole 107 by passing over the counter blade 126. The developer which has passed over the counter blade 126 is carried by the first discharge blade 127 and the second discharge blade 128 and discharged to the outside of the case 105 through the developer discharge hole 107. Herein, the cross-sectional area of the discharge path L is changed according to a progress of the developer along the discharge path L. Therefore, at a portion where the cross-sectional area is changed, a flow direction of the air flowing from the counter blade 126 to the developer discharge hole 107 is changed, thereby scattering a flow of the air. That is, the flow of the air flowing towards the developer discharge hole 107 is suppressed. Therefore, an unintentional discharge of the developer through the developer discharge hole 107 along the flow of the air is suppressed. Accordingly, an excessive discharge of the developer from the developing unit 100 may be suppressed.

The cross-sectional area of the discharge path L may be stepwise decreased towards the developer discharge hole 107. According to the present embodiment, the cross-sectional area of the discharge path L is stepwise changed at a connection portion of the first path part L1 and the second path part L2. In this case, at a portion where the cross-sectional area of the discharge path L is changed, the flow direction of the air flowing towards the developer discharge hole 107 is changed significantly, thereby disturbing the flow of the air. In addition, the change of the flow direction of the air may cause the developer to be separated from the flow of the air. In addition, the discharge path L may be narrowed towards the developer discharge hole 107. Accordingly, the flow of the air is disturbed towards the developer discharge hole 107. Therefore, the excessive discharge of the developer from the developing unit 100 may be further suppressed.

Figure 5:
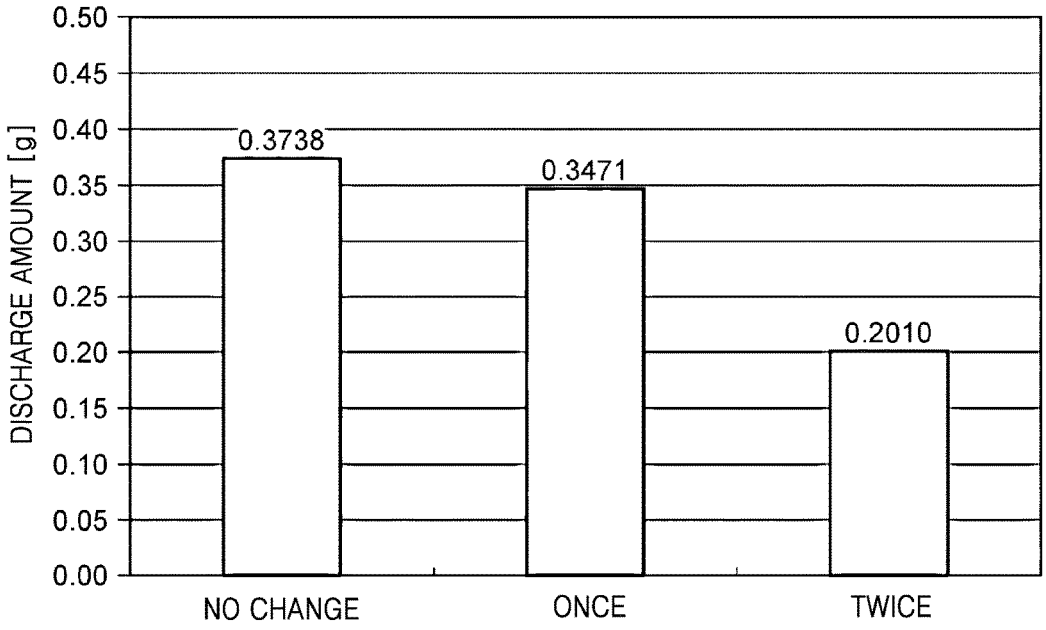
FIG. 5 is a graph showing a measurement result of a discharge amount of developer when a cross-sectional area of the discharge path is changed.

Herein, a measurement result of a discharge amount of the developer discharged along a flow of the air is described. FIG. 5 shows discharge amount measurement results of the developer when the cross-sectional area of the discharge path L was changed once (the first embodiment), when the cross-sectional area of the discharge path L was changed twice, and when the cross-sectional area of the discharge path L was not changed. In addition, when the cross-sectional area of the discharge path L was not changed, a diameter of the discharge path L was 19 mm. When the cross-sectional area of the discharge path L was changed once, a diameter of the discharge path L at a first step was 19 mm, and a diameter of the discharge path L at a second step was 15 mm. When the cross-sectional area of the discharge path L was changed twice, a diameter of the discharge path L at a first step was 19 mm, a diameter of the discharge path L at a second step was 15 mm, and a diameter of the discharge path L at a third step was 11 mm. In any case, a gap between a discharge blade for carrying the developer towards the developer discharge hole 107 in the discharge path L and the discharge path L was 1.5 mm. In this state, a discharge amount of the developer when the developing unit 100 was operated for three minutes was measured. In addition, the developer of which a discharge amount was measured did not include a developer discharged as an amount of a developer inside the developer accommodation space 160 was increased.

As shown in FIG. 5, compared with when the cross-sectional area of the discharge path L was not changed, when the cross-sectional area of the discharge path L was changed once, a discharge amount of the developer was reduced by about 10%. When the cross-sectional area of the discharge path L was changed twice, a discharge amount of the developer was reduced by about 40%. As such, discharging the developer along the flow of the air may be suppressed by changing the cross-sectional area of the discharge path L a plurality of times.

In addition, the cross-sectional area of the first discharge blade 127 is assumed as A. The cross-sectional area of the second path part L2 is assumed as B. In this case, A>B is satisfied. In this case, when the air flows from the first path part L1 to the second path part L2, a linear flow of the air may be suppressed. That is, the stepped portion 105A-4 between the first path part L1 and the second path part L2 functions as a wall which disturbs the flow of the air. Accordingly, since the flow of the air flowing towards the developer discharge hole 107 may be further suppressed, the excessive discharge of the developer from the developing unit 100 may be further suppressed.

Figure 6:
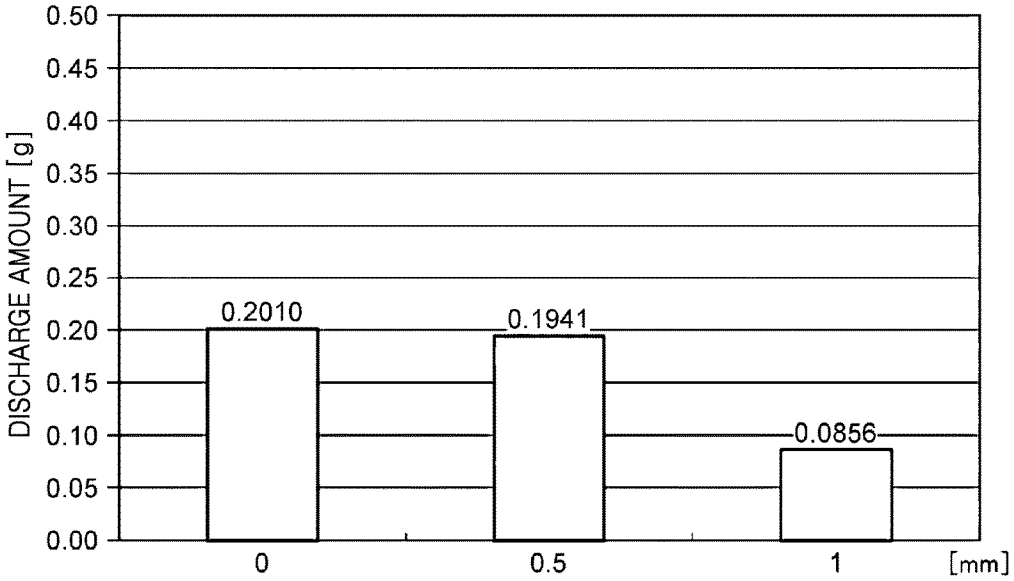
FIG. 6 is a graph showing a measurement result of a discharge amount of the developer when an overlapping amount of a first discharge blade and a second path part is changed.

Herein, a measurement result of a discharge amount of the developer discharged along a flow of the air is described. FIG. 6 shows discharge amounts of the developer when a level difference between the first discharge blade 127 and the second path part L2 is 0 (zero), 0.5 mm, and 1 mm. In this state, a discharge amount of the developer when the developing unit 100 was operated for three minutes was measured. In addition, the developer of which a discharge amount was measured did not include a developer discharged as an amount of a developer inside the developer accommodation space 160 was increased.

As shown in FIG. 6, along with an increase in the level difference between the first discharge blade 127 and the second path part L2, an amount of the developer discharged from the developer discharge hole 107 was reduced. As such, as a level difference between the first discharge blade 127 and the second path part L2 is increased, discharging the developer along a flow of the air may be further suppressed.

A difference between the cross-sectional area of the discharge path L and the cross-sectional area of the first carrying member 120 may be decreased towards the developer discharge hole 107. In this case, a flow path of the air formed between the inner walls 105A-2 and 105A-3 of the first case part 105A and the first and second discharge blades 127 and 128 is narrowed towards the developer discharge hole 107. Accordingly, the flow of the air is disturbed when approaching the developer discharge hole 107. Therefore, the excessive discharge of the developer from the developing unit 100 may be further suppressed.

Figure 7:
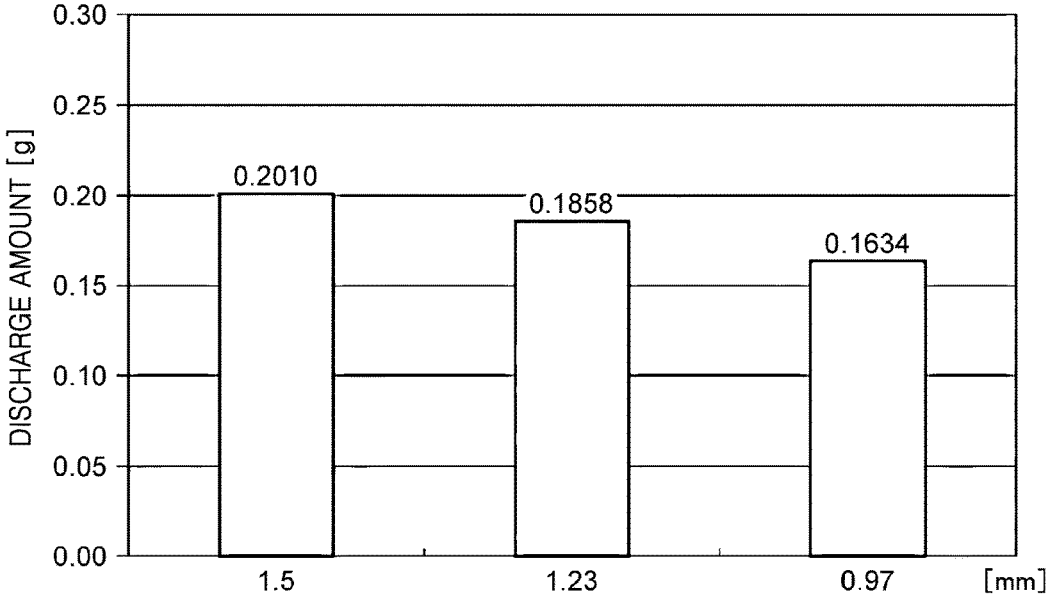
FIG. 7 is a graph showing a measurement result of a discharge amount of the developer when a gap between the discharge path and a first carrying member is changed.

Herein, a measurement result of a discharge amount of the developer discharged along a flow of the air is described. FIG. 7 shows discharge amounts of the developer when a gap between the discharge path L and the first carrying member 120 is 1.5 mm, 1.23 mm, and 0.97 mm. In this state, a discharge amount of the developer when the developing unit 100 was operated for three minutes was measured. In addition, the developer of which a discharge amount was measured did not include a developer discharged as an amount of a developer inside the developer accommodation space 160 was increased.

As shown in FIG. 7, along with a decrease in the gap between the discharge path L and the first carrying member 120, a discharge amount of the developer is reduced. As such, by reducing a difference between the cross-sectional area of the discharge path L and the cross-sectional area of the first carrying member 120, a discharge amount of the developer may be reduced.

(Modified Example)

Figure 8:
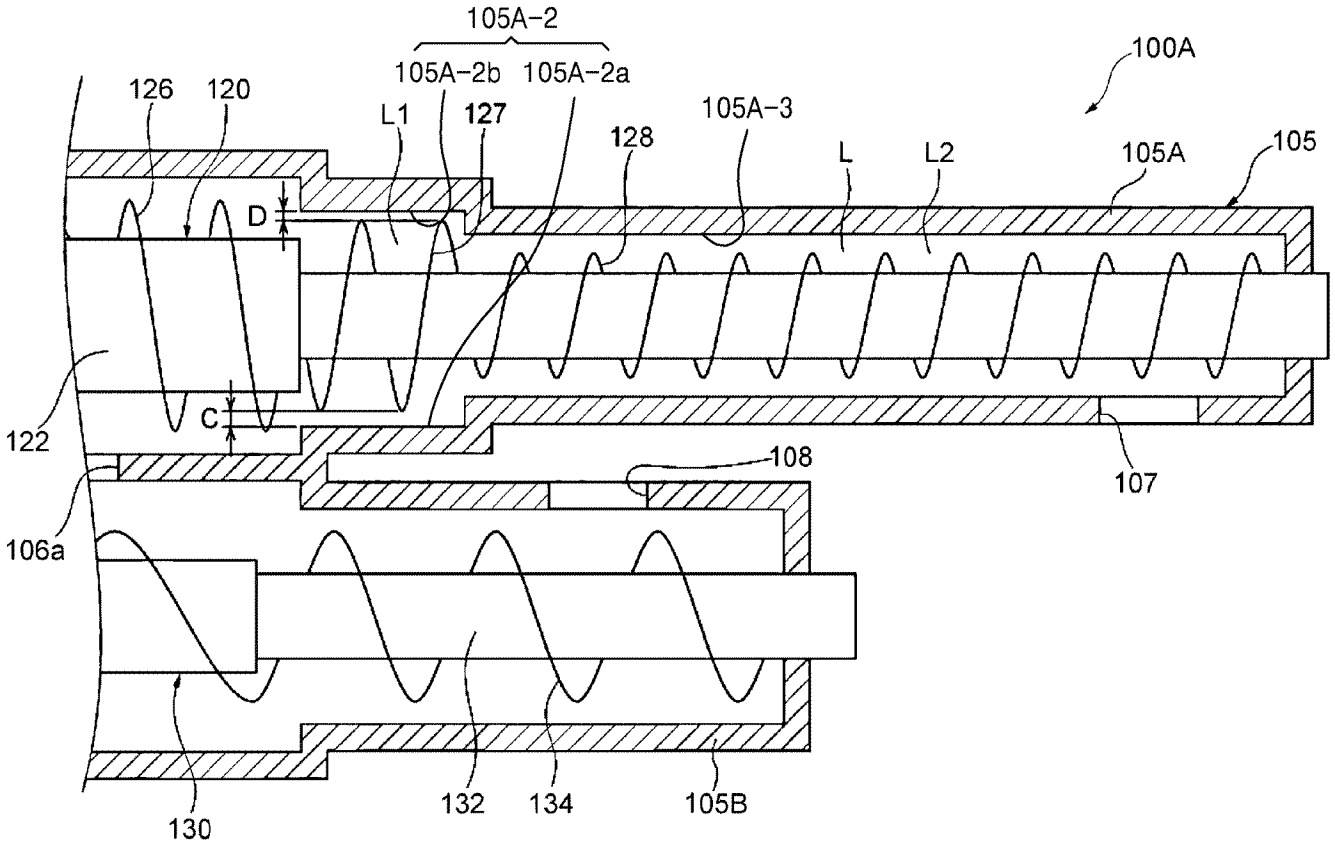
FIG. 8 is a cross-sectional view illustrating a schematic configuration of the developing unit according to a modified example of the first embodiment.

Next, a modified example of the developing unit 100 according to the first embodiment is described. In addition, like reference numerals in the first embodiment denote like elements, and thus their detailed description will be omitted. As shown in FIG. 8, a developing unit 100A according to the present modified example is characterized by a gap between the first discharge blade 127 and an inner wall of the first case part 105A. In detail, a gap between a lower end of the first discharge blade 127 and a lower surface 105A-2*a* of the inner wall 105A-2 of the first case part 105A forming the first path part L1 is assumed as C. A gap between an upper end of the first discharge blade 127 and an upper surface 105A-2*b* of the inner wall 105A-2 of the first case part 105A forming the first path part L1 is assumed as D. in this case, the gaps C and D satisfy a relationship of C>D. In addition, a gap between the second discharge blade 128 and the inner wall 105A-3 of the first case part 105A forming the second path part L2 may also satisfy the same relationship as that for the first discharge blade 127.

When the developing unit 100A is operated, if the inner wall 105A-2 of the first case part 105A and the first discharge blade 127 are in contact with each other in the presence of the developer therebetween, the occurrence of a developer agglomerate may be considered. Because of this, the gap D between the inner wall 105A-2 and the first discharge blade 127 is narrowed at an upper portion of the first discharge path L1 where the developer is not collected. Accordingly, the flow of the air flowing towards the developer discharge hole 107 may be suppressed while suppressing the occurrence of the developer agglomerate. Therefore, the excessive discharge of the developer from the developing apparatus 100A may be further suppressed.

(Second Embodiment)

Figure 9:
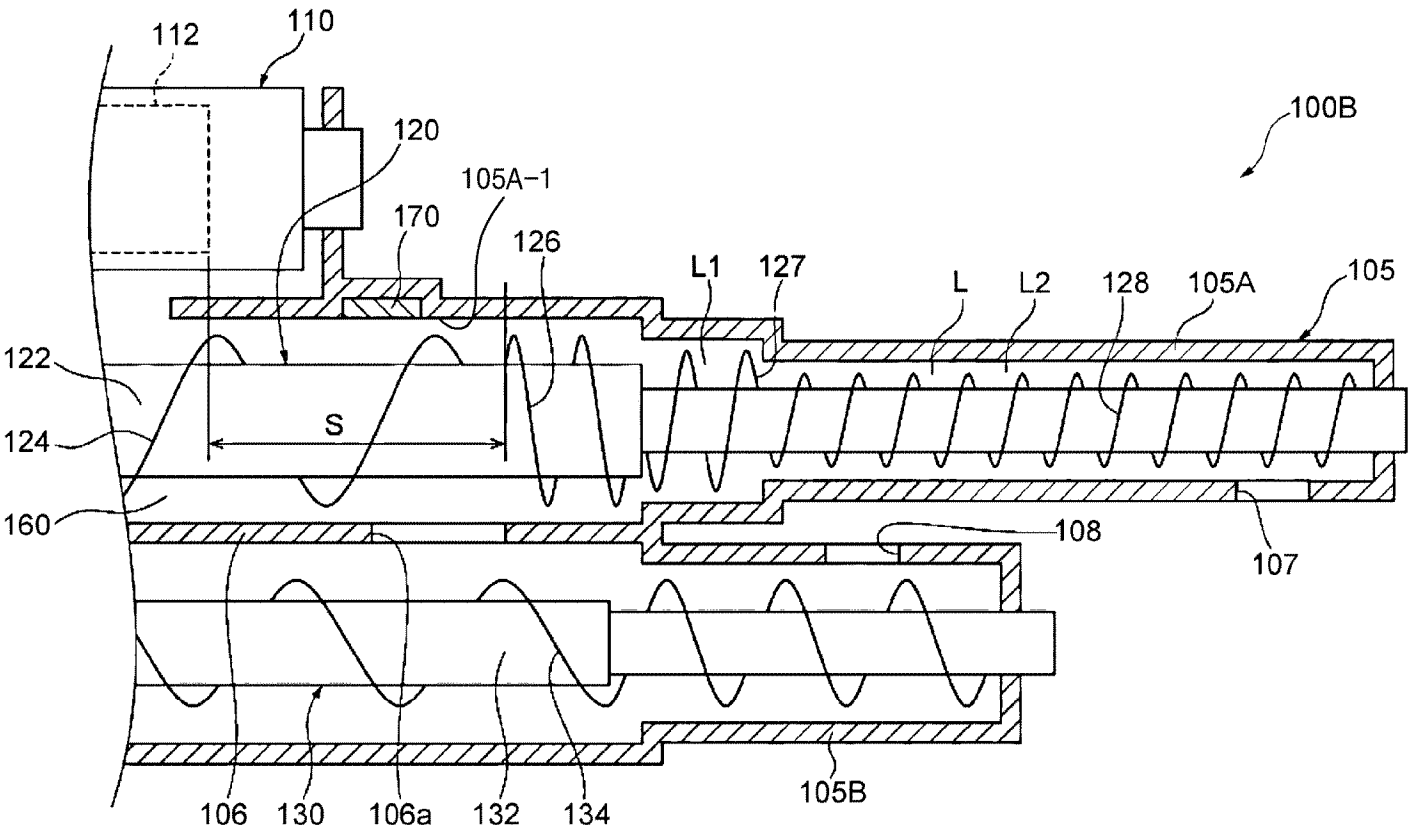
FIG. 9 is a cross-sectional view illustrating a schematic configuration of the developing unit according to the second embodiment.

Next, a second embodiment is described. In addition, like reference numerals in the first embodiment denote like elements, and thus their detailed description will be omitted. As shown in FIG. 9, compared with the developing unit 100 according to the first embodiment, a developing unit 100B according to the present embodiment further includes a magnet for halting developer (developer staying member) 170. The magnet for halting developer 170 is installed in an installation region S. Herein, the installation region S is a region between a counter blade (126)-side end portion of the magnet 112 installed on the developing roller 110 in an extending direction of the first carrying member 120 and the counter blade 126. The magnet for halting developer 170 is installed on the surface of the inner wall 105A-1 of the first case part 105A. The magnet for halting developer 170 is formed of a magnetic substance and pulls the developer by a magnetic force. That is, the magnet for halting developer 170 makes the developer moving towards the counter blade 126 stay in place by a magnetic force.

As described above, by installing the magnet for halting developer 170 in the installation region S, the developer stays in the installation region S. By making the developer stay in the first case part 105A, a flow of the air flowing towards the developer discharge hole 107 is suppressed. Therefore, the excessive discharge of the developer from the developing apparatus 100B may be further suppressed. In addition, by installing the magnet for halting developer 170 at a location between the counter blade (126)-side end portion of the magnet 112 and the counter blade 126, an influence of the magnet for halting developer 170 on image forming performed by the developing roller 110 may be suppressed.

The magnet for halting developer 170 formed of a magnetic substance is used to make the developer stay in place. In this case, the developer may easily stay by the magnet for halting developer 170 formed of a magnetic substance.

Figure 10:
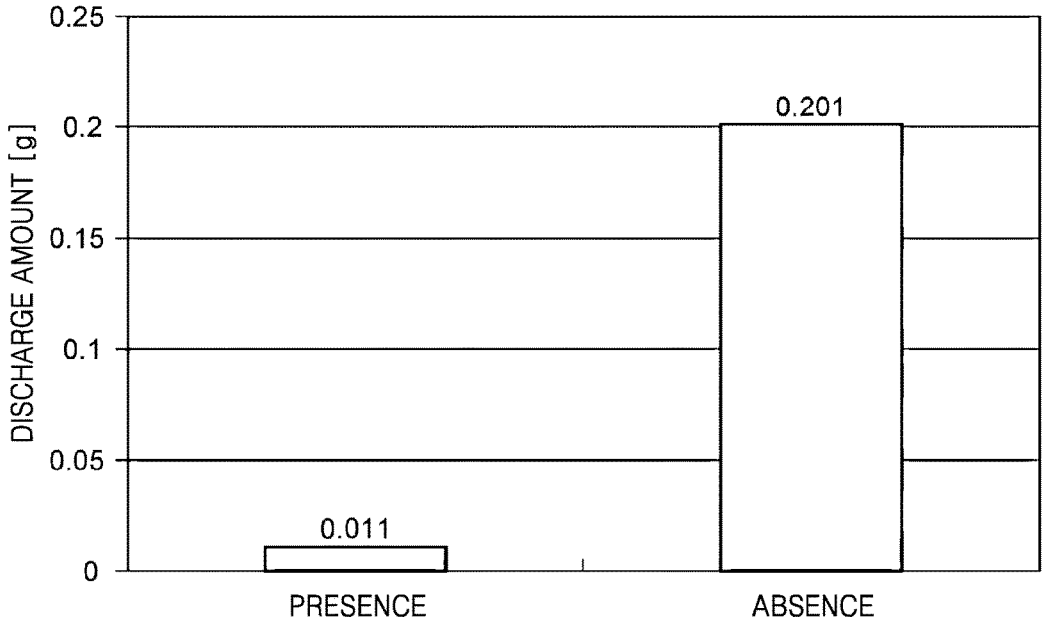
FIG. 10 is a graph showing measurement results of a discharge amount of the developer when a halting magnet is installed and when the halting magnet is not installed.

Herein, a measurement result of a discharge amount of the developer discharged along a flow of the air is described. FIG. 10 shows discharge amounts of the developer when the magnet for halting developer 170 is installed and when the magnet for halting developer 170 is not installed. In this state, a discharge amount of the developer when the developing unit 100B was operated for three minutes was measured. In addition, the developer of which a discharge amount was measured did not include a developer discharged because an amount of a developer inside the developer accommodation space 160 was increased.

As shown in FIG. 10, compared with when the magnet is not installed (absence), when the halting magnet 170 is installed (presence), a discharge amount of the developer became about 1/20. As such, by installing the halting magnet 170, an amount of the developer discharged from the developer discharge hole 107 along a flow of the air may be suppressed.

(First Modified Example)

Figure 11:
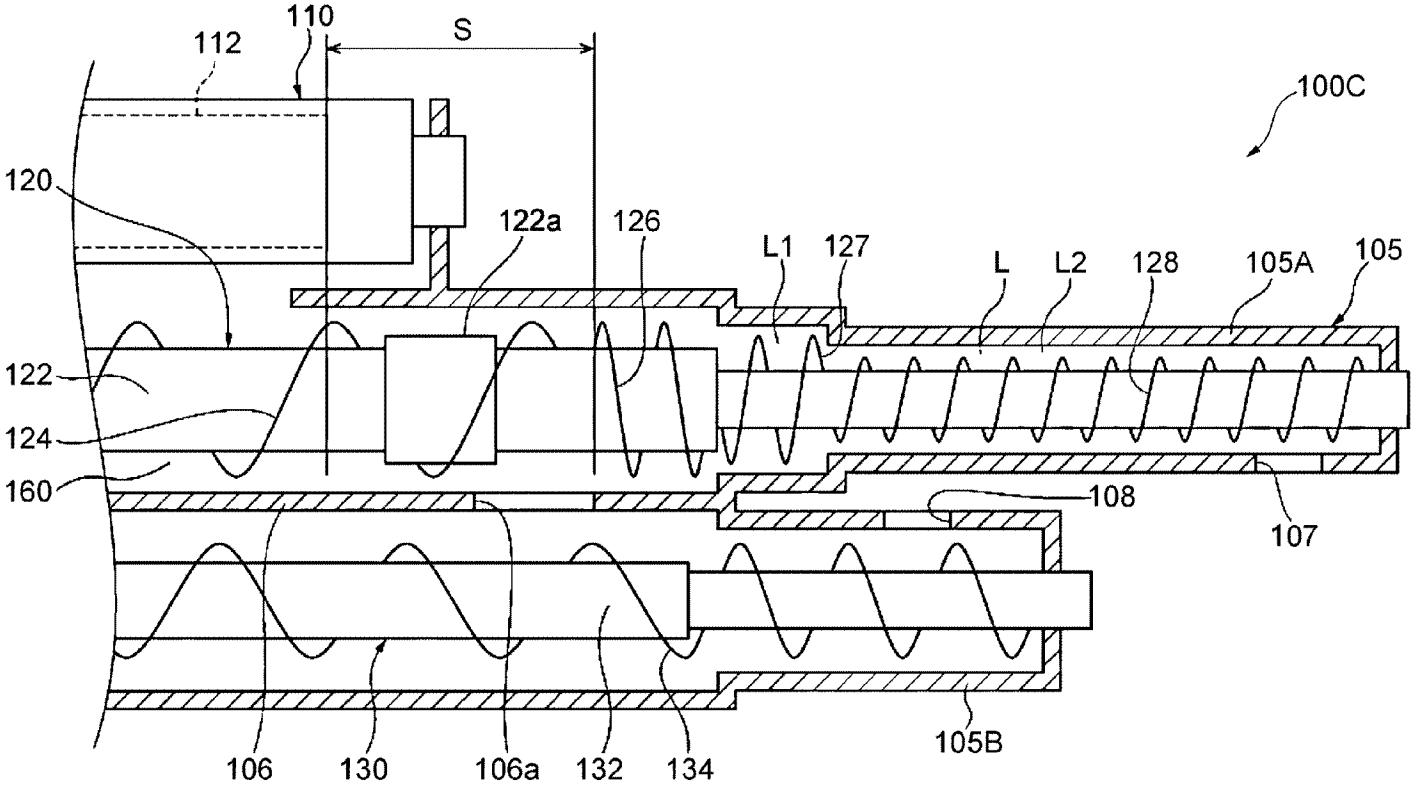
FIG. 11 is a cross-sectional view illustrating a schematic configuration of the developing unit according to a first modified example of the second embodiment.

Next, a first modified example of the second embodiment is described. In addition, like reference numerals in the second embodiment denote like elements, and thus their detailed description will be omitted. As shown in FIG. 11, a developing unit 100C according to the present modified example includes a large diameter part (developer staying member) 122*a* instead of the halting magnet 170 of the developing unit 100B according to the second embodiment. The large diameter part 122*a* is installed in the installation region S. The large diameter part 122*a* is formed by making large a partial outer diameter of the first support shaft (support shaft) 122 in the installation region S.

In this case, a carrying ability of the developer is lowered at a portion where the large diameter part 122*a* is installed. That is, the developer stays in place due to the large diameter part 122*a*. As such, the developer may easily stay in place by the large diameter part 122*a* of the first support shaft 122. By making the developer stay in the first case part 105A, a flow of the air flowing towards the developer discharge hole 107 is suppressed. Therefore, the excessive discharge of the developer from the developing apparatus 100C may be further suppressed.

Second Modified Example

Figure 12:
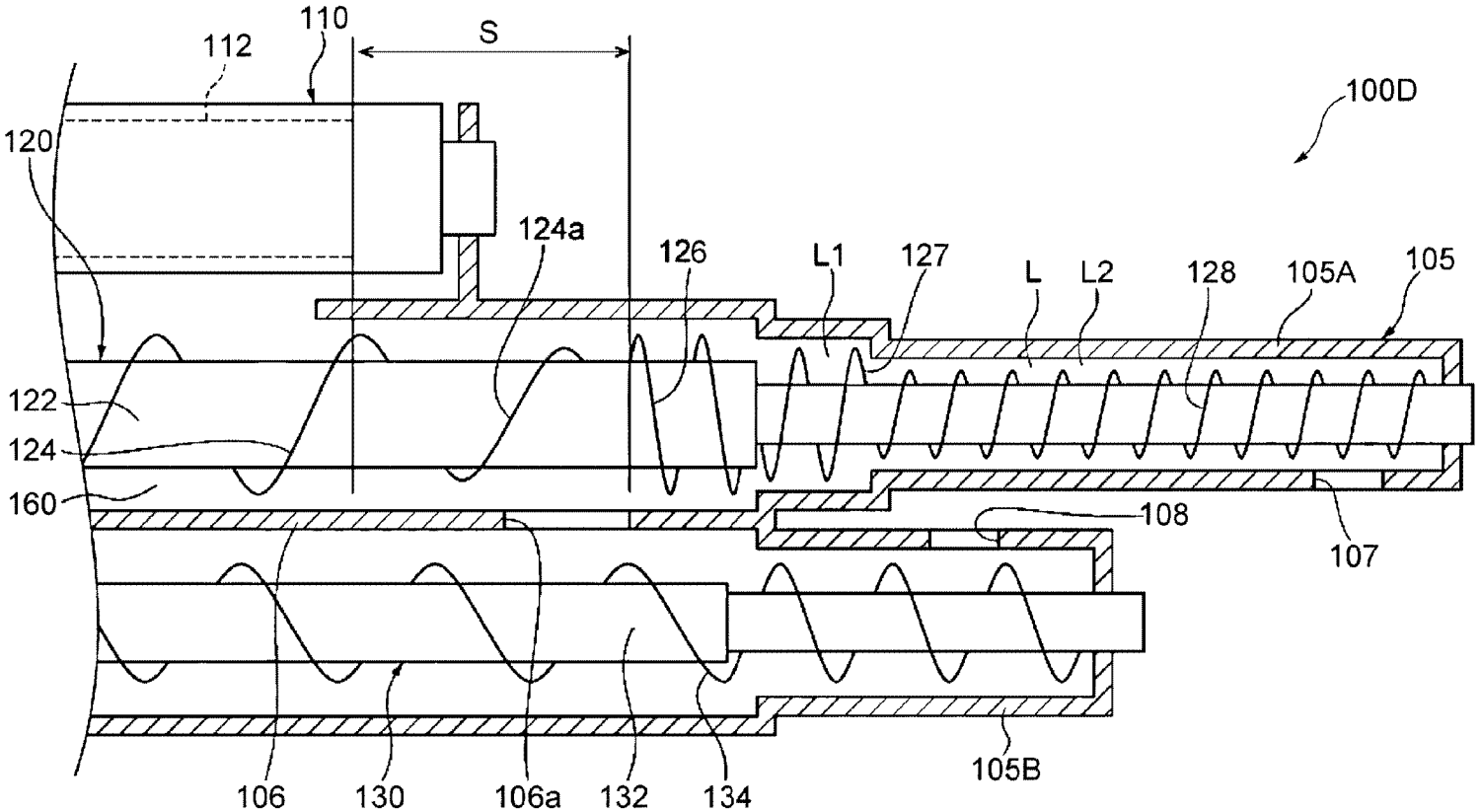
FIG. 12 is a cross-sectional view illustrating a schematic configuration of the developing unit according to a second modified example of the second embodiment.

Next, a second modified example of the second embodiment is described. In addition, like reference numerals in the second embodiment denote like elements, and thus their detailed description will be omitted. As shown in FIG. 12, a developing unit 100D according to the present modified example includes a small diameter part (developer staying member) 124*a* instead of the halting magnet 170 of the developing unit 100B according to the second embodiment. The small diameter part 124*a* is installed in the installation region S. The small diameter part 124*a* is formed by making small a partial outer diameter of the first carrying blade 124 in the installation region S.

In this case, a carrying ability of the developer is lowered at a portion where the small diameter part 124*a* is installed. That is, the developer stays in place due to the small diameter part 124*a*. As such, the developer may easily stay in place by the small diameter part 124*a* of the first support shaft 122. By making the developer stay in the first case part 105A, a flow of the air flowing towards the developer discharge hole 107 is suppressed. Therefore, the excessive discharge of the developer from the developing apparatus 100D may be further suppressed.

Third Modified Example

Figure 13:
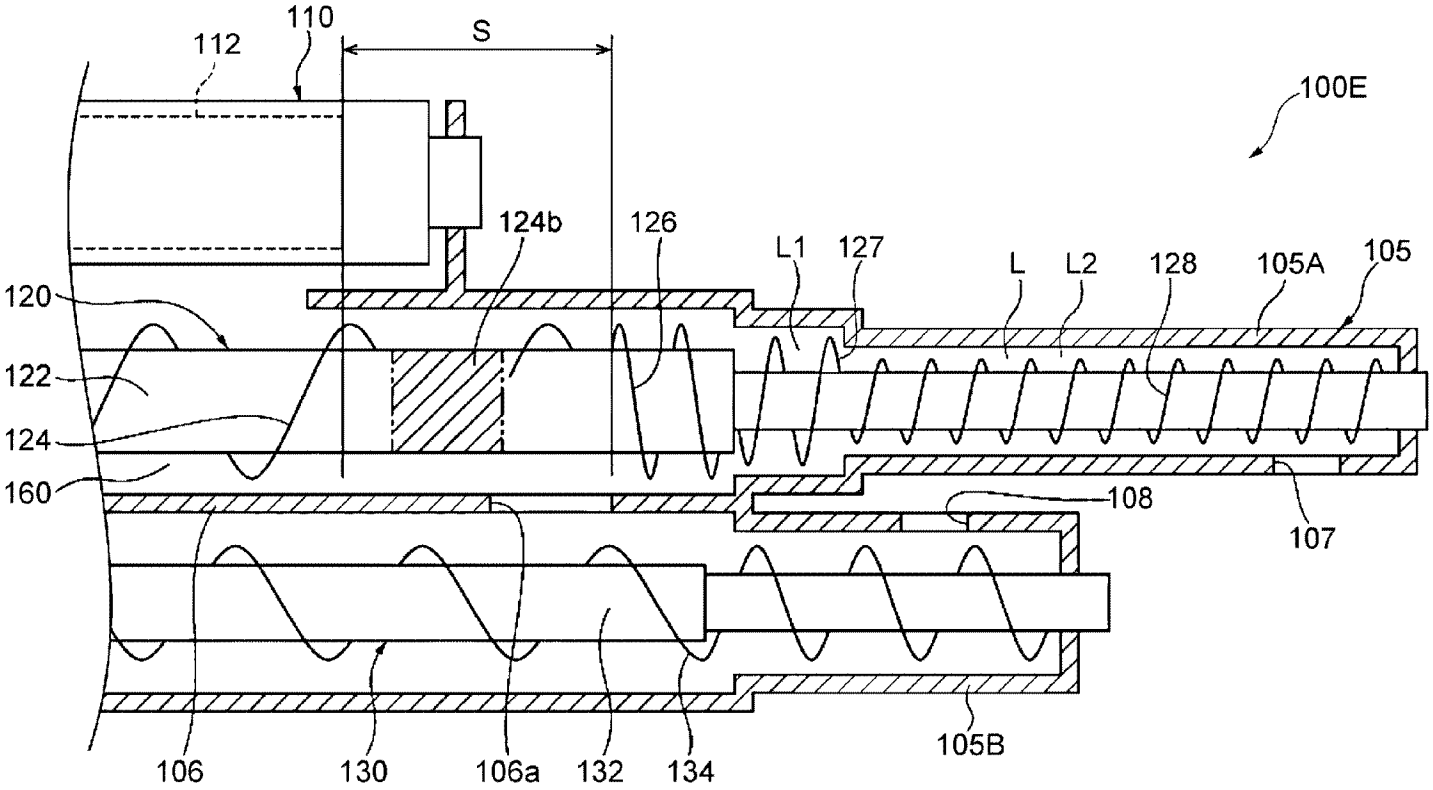
FIG. 13 is a cross-sectional view illustrating a schematic configuration of the developing unit according to a third modified example of the second embodiment.

Next, a third modified example of the second embodiment is described. In addition, like reference numerals in the second embodiment denote like elements, and thus their detailed description will be omitted. As shown in FIG. 13, a developing unit 100E according to the present modified example includes a carrying blade non-installation part (developer staying member) 124*b* instead of the halting magnet 170 of the developing unit 100B according to the second embodiment. The carrying blade non-installation part 124*b* is installed in the installation region S. The carrying blade non-installation part 124*b* is a part on the outer circumferential surface of the first support shaft 122 on which the first carrying blade 124 is not installed in the installation region S.

In this case, a carrying ability of the developer is lowered at the carrying blade non-installation part 124*b* where the first carrying blade 124 is not installed. That is, the developer stays in place due to the carrying blade non-installation part 124*b*. As such, the developer may easily stay in place by the carrying blade non-installation part 124*b* of the first support shaft 122. By making the developer stay in the first case part 105A, a flow of the air flowing towards the developer discharge hole 107 is suppressed. Therefore, the excessive discharge of the developer from the developing apparatus 100E may be further suppressed.

(Fourth Modified Example)

Figure 14:
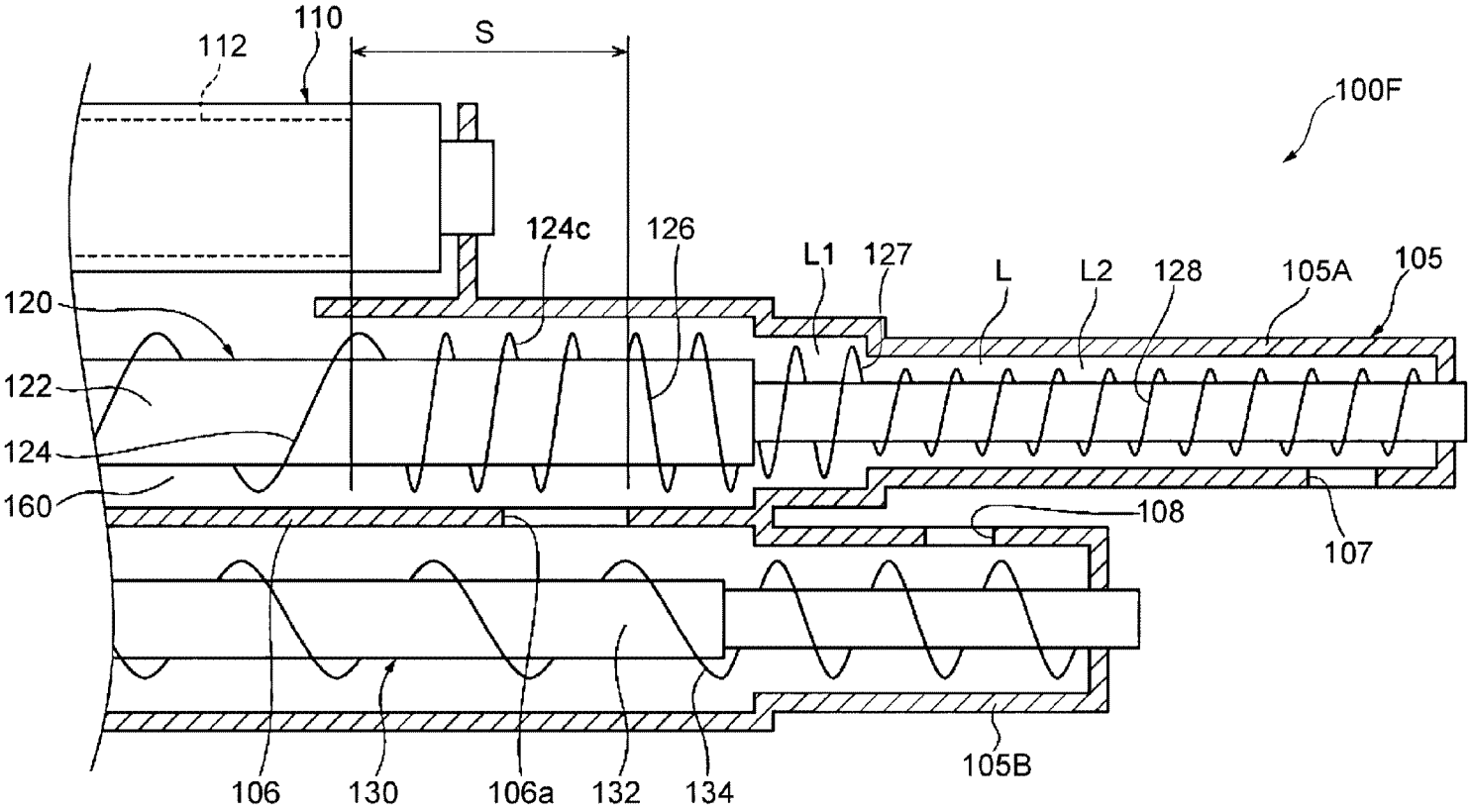
FIG. 14 is a cross-sectional view illustrating a schematic configuration of the developing unit according to a fourth modified example of the second embodiment.

Next, a fourth modified example of the second embodiment is described. In addition, like reference numerals in the second embodiment denote like elements, and thus their detailed description will be omitted. As shown in FIG. 14, a developing unit 100F according to the present modified example includes a small gap part (developer staying member) 124*c* instead of the halting magnet 170 of the developing unit 100B according to the second embodiment. The small gap part 124*c* is installed in the installation region S. The small gap part 124*c* is formed by narrowing a gap between adjacent portions of the first carrying blade 124 in an axial line direction of the first support shaft 122 in the installation region S.

In this case, a carrying speed of the developer is lowered at the small gap part 124*c* where a gap between adjacent portions of the first carrying blade 124 is narrowed. That is, the developer stays at the small gap part 124*c*. As such, the developer may easily stay in place by the small gap part 124*c*. By making the developer stay in the first case part 105A, a flow of the air flowing towards the developer discharge hole 107 is suppressed. Therefore, the excessive discharge of the developer from the developing apparatus 100F may be further suppressed.

(Third Embodiment)

Figure 15:
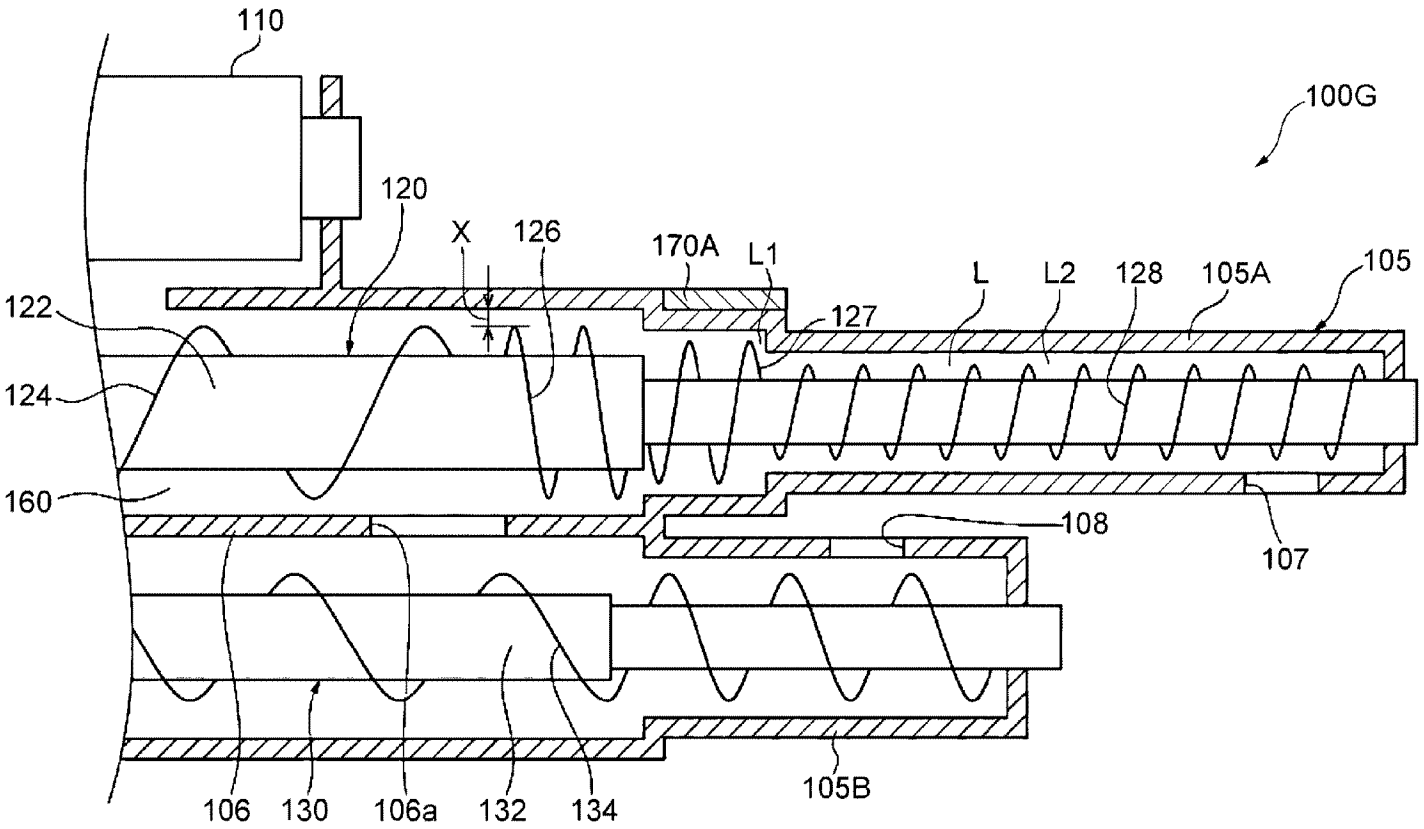
FIG. 15 is a cross-sectional view illustrating a schematic configuration of the developing unit according to a third embodiment.

Next, a third embodiment is described. In addition, like reference numerals in the first embodiment denote like elements, and thus their detailed description will be omitted. As shown in FIG. 15, compared with the developing unit 100 according to the first embodiment, a developing unit 100G according to the present embodiment further includes a halting magnet(magnet) 170A for halting developer. The halting magnet 170A is installed between the counter blade 126 and the developer discharge hole 107. The halting magnet 170A generates a magnetic field to the discharge path L from the counter blade 126 to the developer discharge hole 107. That is, the halting magnet 170A makes the developer moving towards the developer discharge hole 107 stay in place by a magnetic force.

In detail, the halting magnet 170A is installed on the outer surface of the first case part 105A at a location facing the first discharge blade 127 by interposing the first case part 105A therebetween. The halting magnet 170A may cover the first discharge blade 127 all over the outer circumference in a diameter direction of the first support shaft 122. Alternatively, the halting magnet 170A may cover the first discharge blade 127 by a predetermined angle, for example, halfway around the outer circumference of the first discharge blade 127, in the diameter direction of the first support shaft 122. The halting magnet 170A may cover an upper part of the first discharge blade 127. A length of the halting magnet 170A in the axial direction of the first support shaft 122 may be one pitch or more of the first discharge blade 127.

The cross-sectional area of the discharge path L is changed from the counter blade 126 towards the developer discharge hole 107 as well as the first embodiment. In detail, the cross-sectional area of the first path part L1 is greater than that of the second path part L2. Although the cross-sectional area of the discharge path L is changed once in the present embodiment, the cross-sectional area of the discharge path L may be changed twice or more.

Figure 16:
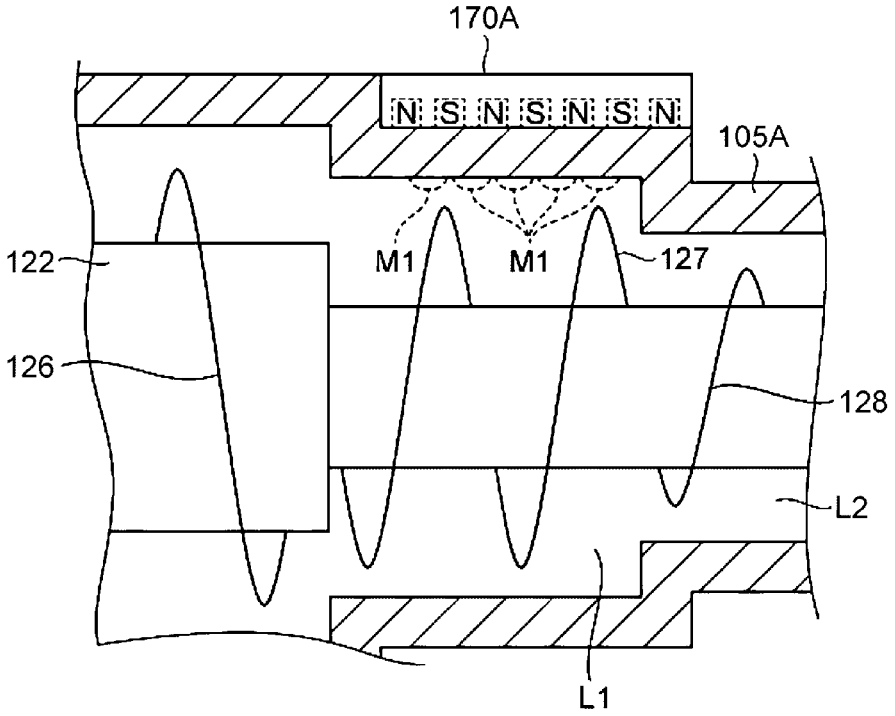
FIG. 16 is a partial enlarged view illustrating a schematic configuration of the surroundings of the halting magnet of the developing unit according to the third embodiment.

As shown in FIG. 16, the halting magnet 170A is a multi-pole magnetization-type magnet. In the halting magnet 170A, N-poles and S-poles are alternately arranged along a discharge direction of the developer in the discharge path L. That is, a plurality of N-poles and S-poles of the halting magnet 170A are alternately arranged along an extending direction of the first support shaft 122.

According to the present embodiment, the halting magnet 170A generates a magnetic field to the discharge path L for the developer. The magnet for halting developer 170A holds the developer by a magnetic force and makes the developer stay in the discharge path L. As such, by making the developer stay in place, a path for the developer moving towards the developer discharge hole 107 is narrowed, thereby suppressing a flow of the air flowing towards the developer discharge hole 107. Therefore, an excessive discharge of the developer from the developing unit 100G may be suppressed.

The N-poles and the S-poles of the magnet for halting developer 170A are alternately arranged along a discharge direction of the developer on the discharge path L. In this case, the developer stays in a band shape due to an influence of a line of magnetic force M1 (see FIG. 16) generated between an adjacent N-pole and S-pole. In addition, this band of the staying developer extends along a direction crossing (orthogonal) to the discharge direction of the developer. That is, the band of the staying developer extends so as to surround an outer circumferential part of the first discharge blade 127. A plurality of N-poles and S-poles are installed alternately, and thus a plurality of bands of the developer are formed along the discharge direction of the developer. Therefore, a flow of the air flowing towards the developer discharge hole 107 is suppressed by the formed plurality of bands of the developer. Therefore, the excessive discharge of the developer from the developing unit 100G may be further suppressed.

The cross-sectional area of the discharge path L is stepwise decreased towards the developer discharge hole 107. Accordingly, a flow of the air flowing towards the developer discharge hole 107 is disturbed as well as the first embodiment. In addition, a change in the flow direction of the air may cause the developer to be separated from the flow of the air. Therefore, the excessive discharge of the developer from the developing unit 100G may be further suppressed.

First Modified Example

Figure 17:
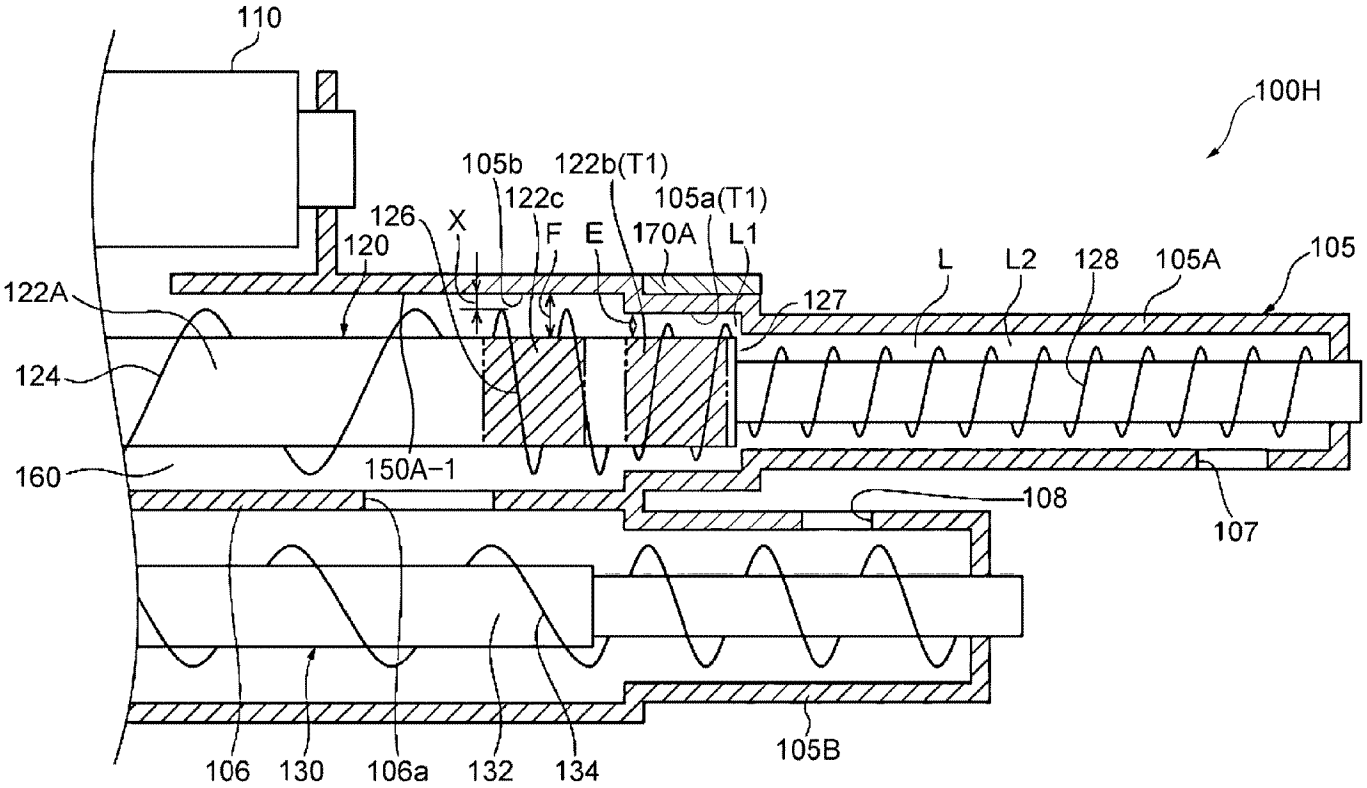
FIG. 17 is a cross-sectional view illustrating a schematic configuration of the developing unit according to a first modified example of the third embodiment.

Next, a first modified example of the third embodiment is described. In addition, like reference numerals in the third embodiment denote like elements, and thus their detailed description will be omitted. As shown in FIG. 17, compared with the developing unit 100G according to the third embodiment, a developing unit 100H according to the present modified example further includes a developer staying member T1. The developer staying member T1 is installed at a location facing the halting magnet 170A in the discharge path L.

The developer staying member T1 is described in detail. Herein, a part of the first support shaft 122 which faces magnet for halting developer 170A is referred to as a first part 122*b*. A part of the first support shaft 122 which is closer to the first opening part 106*a* than the first part 122*b* is referred to as a second part 122*c*. In the present modified example, the second part 122*c* is a part where the counter blade 126 is installed. In addition, a gap between an upper surface of a part 105*a* of the inner wall 105A-1 of the first case part 105A which covers the first part 122*b* and the first part 122*b* is assumed as E. A gap between an upper surface of a part 105*b* of the inner wall 105A-1 of the first case part 105A which covers the second part 122*c* and the second part 122*c* is assumed as F. In this case, the gaps E and F satisfy a relationship of E<F. In addition, the developer staying member T1 is implemented by the part 105*a* of the inner wall 105A-1 of the first case part 105A, which covers the first part 122*b*, and the first part 122*b*.

As described above, a gap between the inner wall 105A-1 of the first case part 105A and the first support shaft 122 is narrowed at a portion facing the halting magnet 170A. A developer passage is narrowed at the portion facing the halting magnet 170A, and thus a lot of developer may be held to the halting magnet 170A. That is, since the developer moving towards the developer discharge hole 107 may further stay in place, a flow of the air flowing towards the developer discharge hole 107 is suppressed. Therefore, the excessive discharge of the developer from the developing unit 100H may be further suppressed.

Second Modified Example

Figure 18:
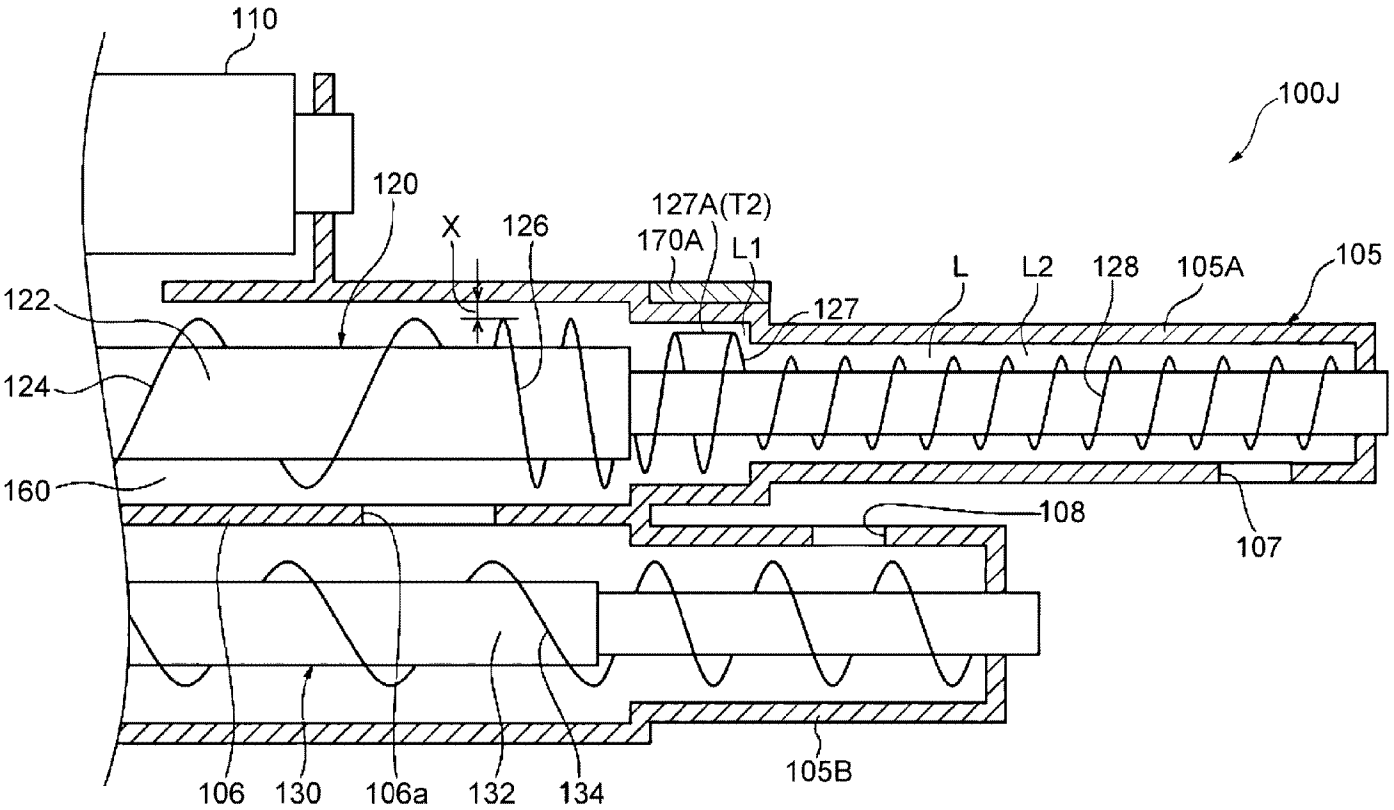
FIG. 18 is a cross-sectional view illustrating a schematic configuration of the developing unit according to a second modified example of the third embodiment.
Figure 19:
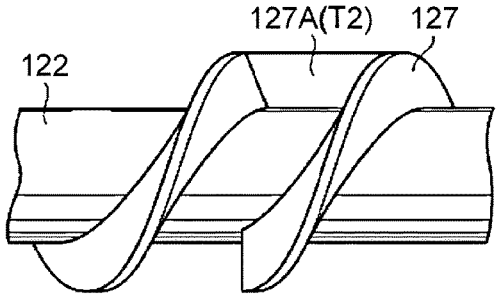
FIG. 19 is a partial enlarged view illustrating a paddle member according to the second modified example of the third embodiment.

Next, a second modified example of the third embodiment is described. In addition, like reference numerals in the third embodiment denote like elements, and thus their detailed description will be omitted. As shown in FIGS. 18 and 19, compared with the developing unit 100G according to the third embodiment, a developing unit 100J according to the present modified example further includes a developer staying member T2. The developer staying member T2 is installed at a location facing the halting magnet 170A in the discharge path L.

The developer staying member T2 is described in detail. In the present modified example, the developer staying member T2 is implemented by a paddle member 127A. As described above, the first discharge blade 127 faces the halting magnet 170A on the first support shaft 122. The paddle member 127A is a plate-shaped member. The paddle member 127A connects adjacent portions of the first discharge blade 127 in the axial direction of the first support shaft 122.

When rotating the first support shaft 122, the paddle member 127A pushes the developer in a direction away from the first support shaft 122. That is, the paddle member 127A pushes the developer towards the halting magnet 170A. Accordingly, an amount of the developer held by the halting magnet 170A is increased, and a flow of the air flowing towards the developer discharge hole 107 is suppressed. Therefore, the excessive discharge of the developer from the developing unit 100J may be further suppressed.

Herein, although the developer staying members T1 and T2 according to the first and second modified examples of the third embodiment have been illustrated, a developer staying member may be implemented in a different shape. For example, the developer staying member may be implemented by replacing the first discharge blade 127 installed at a location facing the halting magnet 170A with the first discharge blade 127 having a narrow pitch (a gap between adjacent portions of a blade in the axial direction of the first support shaft 122). Herein, the narrow pitch of the first discharge blade 127 indicates that the pitch of the first discharge blade 127 is narrower than a pitch of the first carrying blade 124 installed in an upstream side than the first discharge blade 127. By making the pitch of the first discharge blade 127 narrow, a carrying speed of the developer is lowered. As such, by slowing down a carrying speed of the developer at a part facing the halting magnet 170A, an amount of the developer held to the halting magnet 170A may be increased. Therefore, in this case, a flow of the air flowing towards the developer discharge hole 107 is also suppressed. In addition, an excessive discharge of the developer from a developing unit may be further suppressed.

Figure 20:
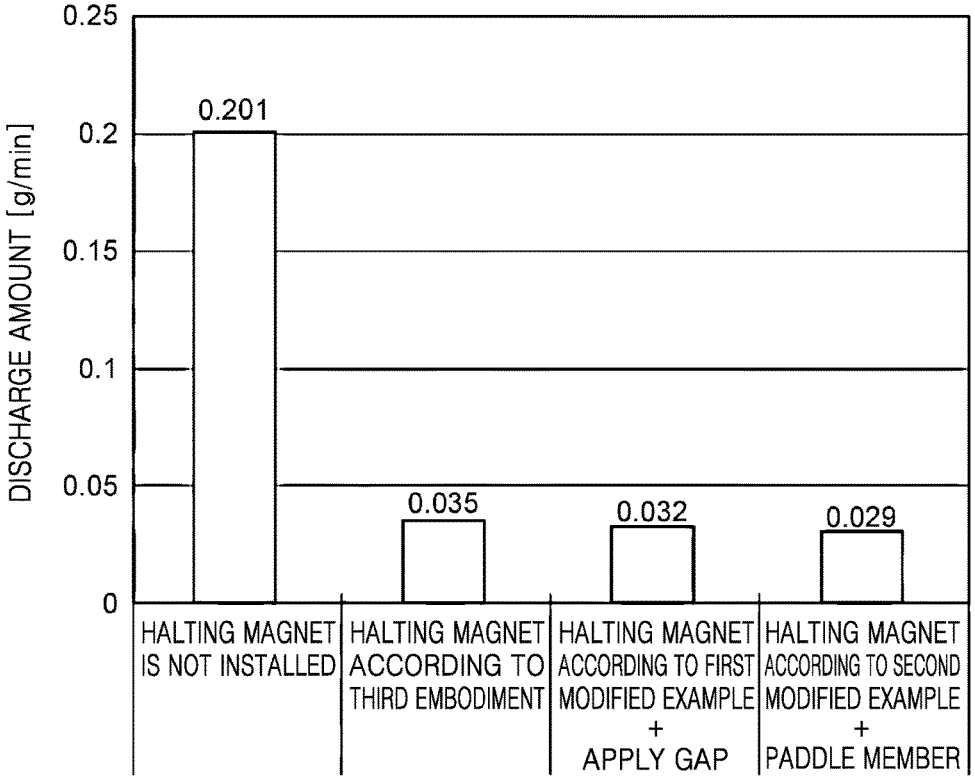
FIG. 20 is a graph showing a measurement result of a discharge amount of the developer.

Herein, a measurement result of a discharge amount of the developer discharged from the developer discharge hole 107 along a flow of the air is described. FIG. 20 shows measurement results when the halting magnet 170A is not installed, when the developing unit 100G according to the third embodiment is used, when the developing unit 100H according to the first modified example of the third embodiment is used, and when the developing unit 100J according to the second modified example of the third embodiment is used. In addition, the measurement result when the halting magnet 170A is not installed is a result for comparison. In addition, the measurement result when the halting magnet 170A is not installed is a result measured by removing the halting magnet 170A from the developing unit 100G according to the third embodiment. Discharge amounts of the developer for one minute operation of the developing units were measured. In addition, the developer of which a discharge amount was measured did not include a developer discharged as an amount of a developer inside the developer accommodation space 160 was increased.

As shown in FIG. 20, compared with the developing unit without including the halting magnet 170A, a discharge amount of the developer in the developing unit 100G including the halting magnet 170A was reduced significantly. The developing unit 100H further including the developer staying member T1 according to the first modified example exhibited a less discharge amount of the developer than the developing unit 100G according to the third embodiment. In addition, the developing unit 100J further including the developer staying member T2 according to the second modified example exhibited a much less discharge amount of the developer than the developing unit 100G according to the third embodiment.

(Fourth Embodiment)

Figure 21:
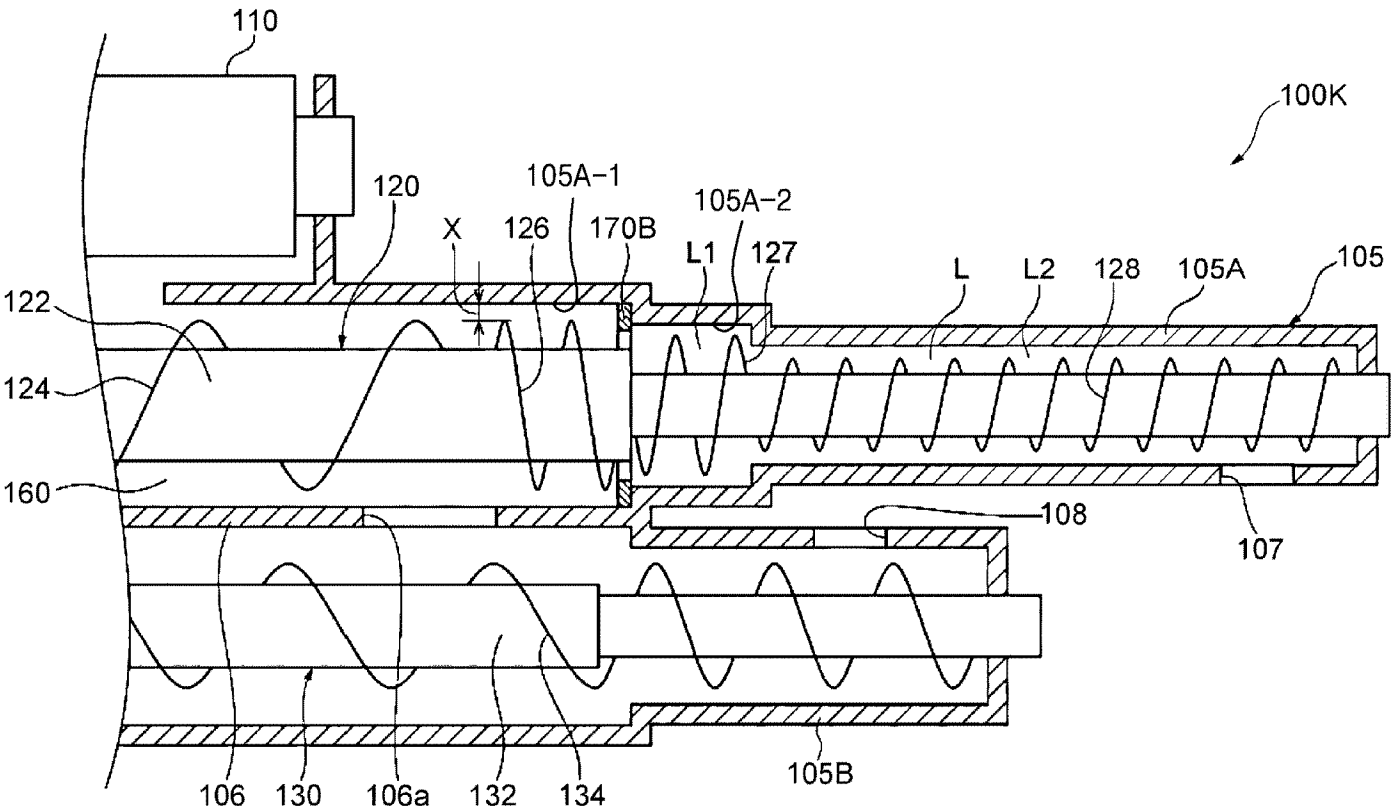
FIG. 21 is a cross-sectional view illustrating a schematic configuration of the developing unit according to a fourth embodiment.

Next, a fourth embodiment is described. In addition, like reference numerals in the first embodiment denote like elements, and thus their detailed description will be omitted. As shown in FIG. 21, compared with the developing unit 100 according to the first embodiment, a developing unit 100K according to the present embodiment further includes a halting magnet(magnet)170B.

Herein, on the first support shaft 122, the first carrying blade (upstream side carrying blade) 124 is installed in an upstream side than the counter blade 126, and the first discharge blade (downstream side carrying blade) 127 and the second discharge blade (downstream side carrying blade) 128 are installed in a downstream side than the counter blade 126. That is, the upstream side carrying blade 124 and the downstream side carrying blade 127 and 128 are located at a side of the second opening part 106*b* and a side of the developer discharge hole 107, respectively, by interposing the counter blade 126 therebetween. The halting magnet 170B is installed between the counter blade 126 and the first discharge blade 127. The halting magnet 170B makes the developer moving towards the developer discharge hole 107 stay in place by a magnetic force.

Figure 22:
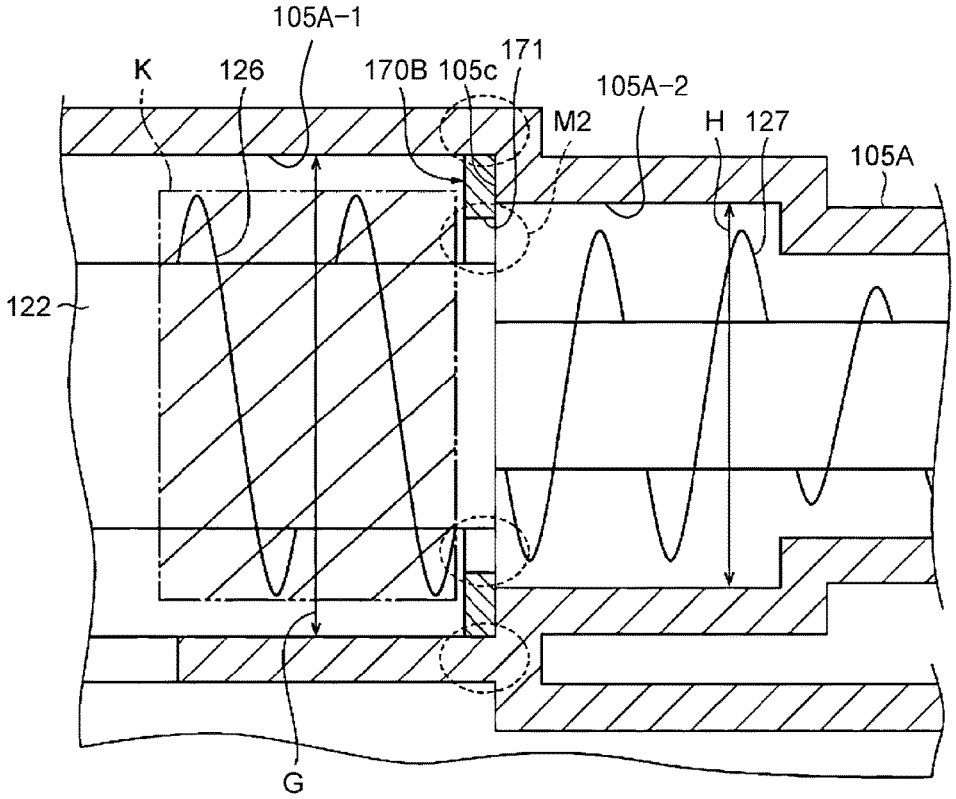
FIG. 22 is a partial enlarged view illustrating a schematic configuration of the surroundings of the halting magnet of the developing unit according to the fourth embodiment.

In detail, as shown in FIGS. 21 and 22, the halting magnet 170B is a ring-shaped member having a hole 171. Herein, in the first case part 105A, an inner diameter G of the part 105A-1 covering the counter blade 126 is greater than an inner diameter H of the part 105A-2 covering the first discharge blade 127. That is, on an inner wall of the first case part 105A, a stepped portion 105*c* is formed at a boundary between the part 105A-1 covering the counter blade 126 and the part 105A-2 covering the first discharge blade 127. The halting magnet 170B is installed at the stepped portion 105*c*. Accordingly, a location of the halting magnet 170B may be easily determined. In addition, the halting magnet 170B may be easily fixed to the first case part 105A.

In the first case part 105A, the inner diameter H of the part 105A-2 covering the first discharge blade 127 is greater than a diameter of the hole 171 of the halting magnet 170B. That is, in the first case part 105A, an inner-circumferential side edge of the halting magnet 170B extends more towards the first support shaft 122 than an inner wall of the part 105A-2 covering the first discharge blade 127. The diameter of the hole 171 of the halting magnet 170B is greater than an outer diameter of the first discharge blade 127 and an outer diameter of the second discharge blade 128. Accordingly, a portion of the first support shaft 122 at which the second discharge blade 128 is installed may pass into the hole 171 of the halting magnet 170B.

The diameter of the hole 171 of the halting magnet 170B is less than an outer diameter of the counter blade 126. That is, the halting magnet 170B has a region overlapping the counter blade 126 when viewing the magnet for halting developer 170B along the axial direction of the first support shaft 122. In detail, an edge portion of the hole 171 of the halting magnet 170B overlaps an outer-circumferential edge portion of the counter blade 126. Herein, when the counter blade 126 is rotated, a region through which the counter blade 126 passes is referred to a rotation trajectory K. A magnetic field generation region M2 to which a magnetic field of the halting magnet 170B is applied overlaps the rotation trajectory K. That is, a distance between the counter blade 126 and the halting magnet 170B (axial-direction distance of the first support shaft 122) is set such that the magnetic field generation region M2 overlaps the rotation trajectory K.

In addition, a developer moved into the inside of the rotation trajectory K among a developer held by the halting magnet is carried towards the first opening part 106*a* by the rotating counter blade 126. That is, an excessive stay of the developer around the halting magnet 170B is suppressed. The distance between the counter blade 126 and the halting magnet 170B may be set to a distance by which a surplus developer held by the halting magnet 170B can be carried towards the first opening part 106*a* by the counter blade 126.

The halting magnet 170B is a double-sided magnetization magnet. The halting magnet 170B may be arranged such that an N-pole orients towards the counter blade 126 and an S-pole orients towards the first discharge blade 127. Alternatively, the halting magnet 170B may be arranged such that the N-pole orients towards the first discharge blade 127 and the S-pole orients towards the counter blade 126.

The cross-sectional area of the discharge path L is changed from the counter blade 126 towards the developer discharge hole 107 as well as the first embodiment. In detail, the cross-sectional area of the first path part L1 is greater than that of the second path part L2. Although the cross-sectional area of the discharge path L is changed once in the present embodiment, the cross-sectional area of the discharge path L may be changed twice or more.

Figure 23:
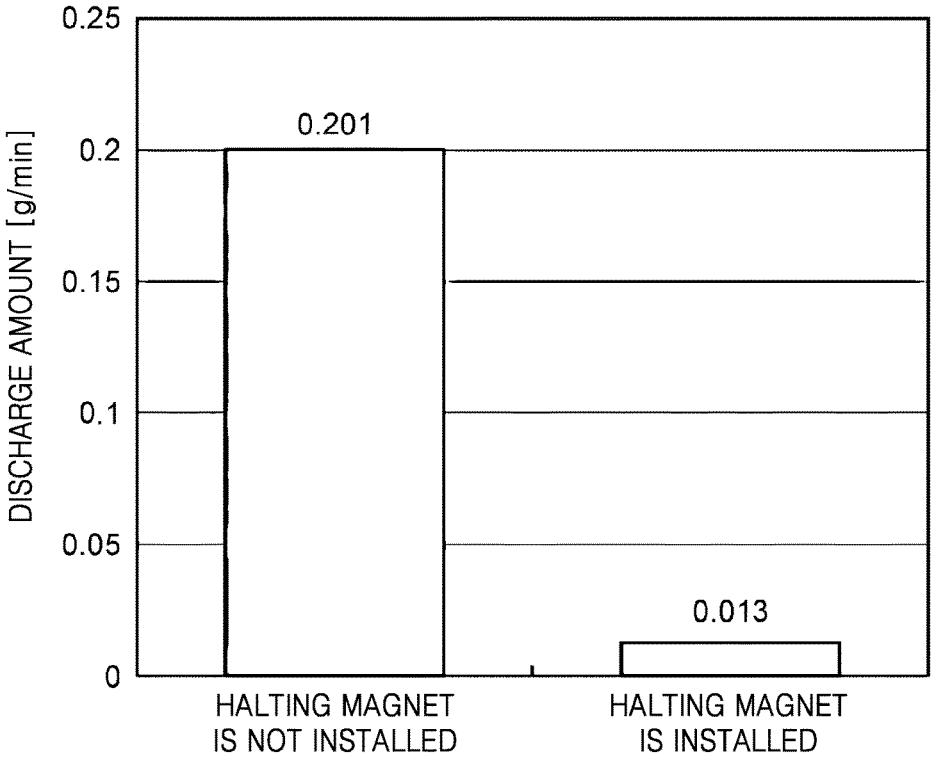
FIG. 23 is a graph showing a measurement result of a discharge amount of the developer.

Herein, a measurement result of a discharge amount of the developer discharged through the developer discharge hole 107 along a flow of the air is described. FIG. 23 shows measurement results when the halting magnet 170B is not installed and when the developing unit 100K according to the fourth embodiment is used (the halting magnet 170B is installed). In addition, the measurement result when the halting magnet 170B is not installed is a result for comparison. In addition, the measurement result when the magnet for halting developer 170B is not installed is a result measured by removing the halting magnet 170B from the developing unit 100K according to the fourth embodiment. Discharge amounts of the developer for one minute operation of the developing units were measured. In addition, the developer of which a discharge amount was measured did not include a developer discharged as an amount of a developer inside the developer accommodation space 160 was increased. As shown in FIG. 23, compared with the developing unit without including the halting magnet 170B, a discharge amount of the developer in the developing unit 100K according to the fourth embodiment including the halting magnet 170B was reduced significantly.

According to the present embodiment, the halting magnet 170B generates a magnetic field to the discharge path L for the developer. The halting magnet 170B holds the developer by a magnetic force and makes the developer stay in the discharge path L. As such, by making the developer stay in place, a path for the developer moving towards the developer discharge hole 107 is narrowed, thereby suppressing a flow of the air flowing towards the developer discharge hole 107. Therefore, an excessive discharge of the developer from the developing unit 100K may be suppressed.

In addition, a portion of the developer staying in place by the halting magnet 170B is carried back towards the first opening part 106*a* by the counter blade 126. Accordingly, the developing unit 100K may make the developer stay in place by the halting magnet 170B while carrying a surplus developer, which stays in place by the halting magnet 170B, towards the first opening part 106*a*. That is, excessive holding of the developer by the halting magnet 170B may be suppressed.

The halting magnet 170B is a double-sided magnetization magnet. The halting magnet 170B may be arranged such that the N-pole orients towards the counter blade 126 and the S-pole orients towards the first discharge blade 127. Alternatively, the magnet for halting developer 170B may be arranged such that the N-pole orients towards the first discharge blade 127 and the S-pole orients towards the counter blade 126. In this case, the developer stays in a band shape due to an influence of a line of magnetic force generated between the N-pole and S-pole of the halting magnet 170B. In addition, this band of the staying developer extends along a direction crossing (orthogonal) to the discharge direction of the developer. That is, a band of developer is formed along an inner circumferential surface of the hole 171 of the halting magnet 170B. Therefore, the flow of the air flowing towards the developer discharge hole 107 is effectively suppressed by the band of the staying developer. Therefore, the excessive discharge of the developer from the developing unit 100K may be further suppressed.

The cross-sectional area of the discharge path L is stepwise decreased towards the developer discharge hole 107. Accordingly, the flow of the air flowing towards the developer discharge hole 107 is disturbed as well as the first embodiment. In addition, a change in the flow direction of the air may cause the developer to be separated from the flow of the air. Therefore, the excessive discharge of the developer from the developing unit 100K may be further suppressed.

Figure 24:
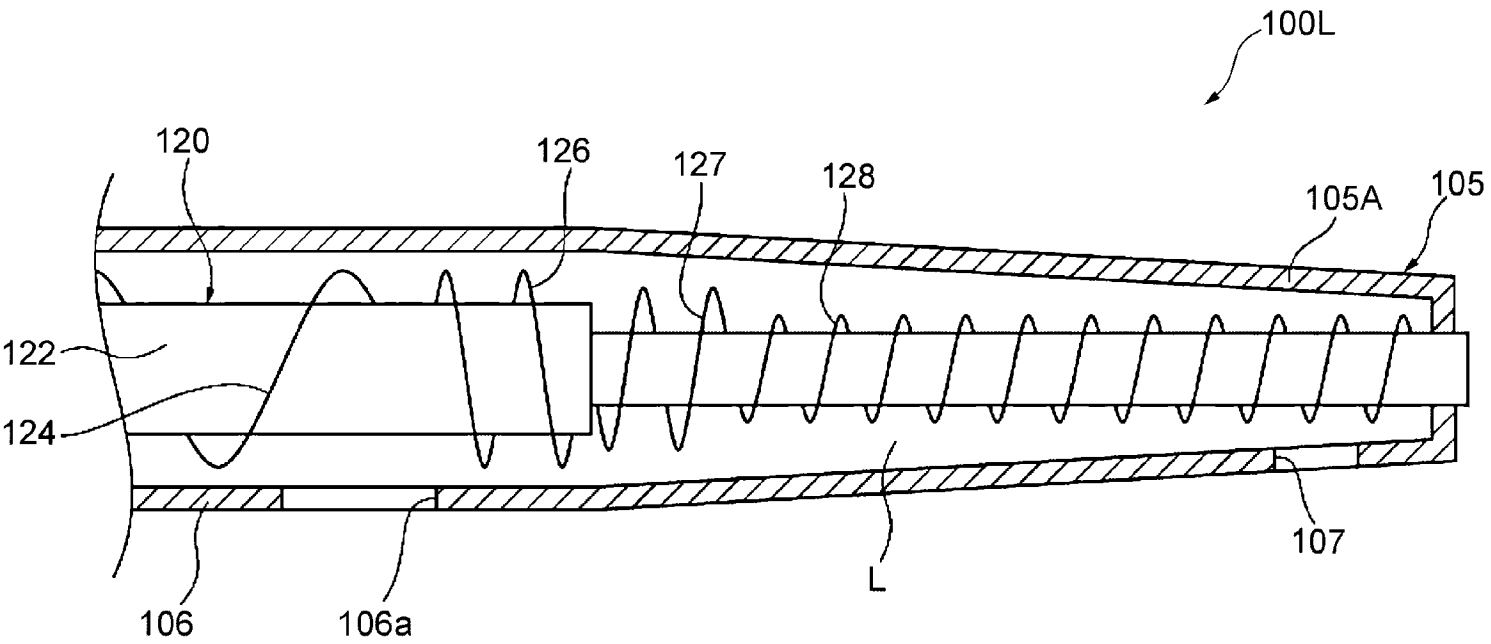
FIG. 24 is a cross-sectional view illustrating a schematic configuration of the surroundings of the discharge path of the developing unit according to another modified example.

Although the embodiments of the present invention have been described, the present invention is not limited to the embodiments. For example, the cross-sectional area of the discharge path L may be continuously decreased towards the developer discharge hole 107 as in a developing unit 100L shown in FIG. 24. That is, an inner circumferential surface of the first case part 105A forming the discharge path L may be narrowed in a tapered shape towards the developer discharge hole 107. Even in this case, as described with reference to the first embodiment and the like, a flow of the air flowing towards the developer discharge hole 107 is suppressed. Accordingly, an excessive discharge of the developer from the developing unit 100L may be further suppressed.

In addition, the tandem-type image forming apparatus 1 shown in FIG. 1 is an example of image forming apparatuses using the developing unit 100 or the like according to the present embodiments, and the developing unit 100 and the like according to the present embodiments may be applied to various types of image forming apparatuses. In addition, the configurations of the developing unit 100 and the like are also not limited to the examples described with reference to the embodiments, and the present invention may be applied to various types of developing units having the developer discharge hole 107.

The invention claimed is:

1. A developing apparatus comprising:

first and second case parts;

first and second opening parts for allowing the first and second case parts to communicate with each other;

a developing roller installed in the first case part;

a first carrying member installed in the first case part to carry, towards the first opening part, developer introduced from the second case part through the second opening part and to supply the developer to the developing roller;

a second carrying member installed in the second case part to carry, towards the second opening part, the developer introduced from the first case part through the first opening part; and a developer discharge hole provided in the first case part at an opposite side to the second opening part, wherein the first carrying member comprises a carrying blade for carrying the developer towards the first opening part and a counter blade located between the first opening part and the developer discharge hole to carry the developer towards the first opening part, a first gap is prepared between the counter blade and an inner wall of the first case part, and a cross-sectional area of a discharge path for the developer from the counter blade to the developer discharge hole within the first case part changes according to a progress of the developer along the discharge path, and in the discharge path, when a second gap between a first end of the counter blade and a corresponding first surface of a part of the inner wall of the first case part which forms the discharge path is C, and a third gap between a second end of the counter blade and a corresponding second surface of the part of the inner wall of the first case part which forms the discharge path is D, a relationship of C>D is satisfied.

2. The developing apparatus of claim 1, wherein the cross-sectional area of the discharge path is stepwise decreased towards the developer discharge hole.

3. The developing apparatus of claim 2, wherein the discharge path comprises a first path part and a second path part adjacent to the first path part and located closer to the developer discharge hole than the first path part, and when a cross-sectional area of a part of the first carrying member located on the first path part is A, and a cross-sectional area of the second path part is B, a relationship of A>B is satisfied.

4. The developing apparatus of claim 1, wherein the cross-sectional area of the discharge path is continuously decreased towards the developer discharge hole.

5. The developing apparatus of claim 1, wherein a difference between the cross-sectional area of the discharge path and a cross-sectional area of the first carrying member is decreased towards the developer discharge hole.

6. The developing apparatus of claim 1, wherein in the discharge path, the first end is a lower end of the counter blade and the corresponding first surface is a lower surface of the part of the inner wall of the first case part, and the second end is an upper end of the counter blade and the corresponding second surface is an upper surface of the part of the inner wall of the first case part.

7. The developing apparatus of claim 1, further comprising a magnet located on the discharge path to make the developer stay in place by a magnet force.

8. The developing apparatus of claim 7, further comprising a developer staying member located at a location facing the magnet to make the developer stay in place.

9. The developing apparatus of claim 8, wherein the first carrying member further comprises a support shaft having the carrying blade installed on an outer circumferential surface thereof, when a part of the support shaft facing the magnet is a first part, a part of the support shaft closer to the first opening part than the first part is a second part, a gap between an upper surface of a part of the inner wall of the first case part which covers the first part and the first part is E, and a gap between an upper surface of a part of the inner wall of the first case part which covers the second part and the second part is F, a relationship of E<F is satisfied, and the developer staying member is implemented by the part of the inner wall of the first case part, which covers the first part, and the first part.

10. The developing apparatus of claim 8, wherein the first carrying member further comprises:

a support shaft having the carrying blade installed in a spiral shape on an outer circumferential surface thereof; and a paddle member installed at a location facing the magnet to connect adjacent portions of the carrying blade in an axial direction of the support shaft, and the developer staying member is implemented by the paddle member.

11. The developing apparatus of claim 7, wherein the first carrying member further comprises a support shaft having the carrying blade installed on an outer circumferential surface thereof, and the magnet has a region overlapping the counter blade when viewing the magnet in an axial direction of the support shaft.

12. The developing apparatus of claim 11, wherein the carrying blade comprises an upstream side carrying blade and a downstream side carrying blade respectively located at a second opening part side and a developer discharge hole side by interposing the counter blade therebetween, a gap is prepared between an upper part of the counter blade and the inner wall of the first case part covering the counter blade, and the magnet is installed between the counter blade and the downstream side carrying blade.

13. A developing apparatus, comprising:

first and second case parts;

first and second opening parts for allowing the first and second case parts to communicate with each other;

a developing roller installed in the first case part;

a first carrying member installed in the first case part to carry, towards the first opening part, developer introduced from the second case part through the second opening part and to supply the developer to the developing roller;

a second carrying member installed in the second case part to carry, towards the second opening part, the developer introduced from the first case part through the first opening part; and a developer discharge hole provided in the first case part at an opposite side to the second opening part, wherein the first carrying member comprises a carrying blade for carrying the developer towards the first opening part and a counter blade located between the first opening part and the developer discharge hole to carry the developer towards the first opening part, a gap is prepared between the counter blade and an inner wall of the first case part, a cross-sectional area of a discharge path for the developer from the counter blade to the developer discharge hole within the first case part changes according to a progress of the developer along the discharge path, a magnet for attracting the developer is installed inside the developing roller, and the developing apparatus comprises a developer staying member installed at a location between a counter blade-side end portion of the magnet and the counter blade in an extending direction of the first carrying member to make the developer stay in place.

14. The developing apparatus of claim 13, wherein the developer staying member comprises a magnetic substance and is installed inside the first case part.

15. The developing apparatus of claim 13, wherein the first carrying member further comprises a support shaft having the carrying blade installed on an outer circumferential surface thereof, a large diameter part having a large outer diameter is prepared at the location between the counter blade-side end portion of the magnet and the counter blade on the support shaft, and the developer staying member is implemented by the large diameter part.

16. The developing apparatus of claim 13, wherein the carrying blade comprises a small diameter part having a small outer diameter at the location between the counter blade-side end portion of the magnet and the counter blade, and the developer staying member is implemented by the small diameter part.

17. The developing apparatus of claim 13, wherein the first carrying member further comprises a support shaft having the carrying blade installed on an outer circumferential surface thereof, the support shaft comprises a carrying blade non-installation part, on which the carrying blade is not installed, at the location between the counter blade-side end portion of the magnet and the counter blade, and the developer staying member is implemented by the carrying blade non-installation part.

18. The developing apparatus of claim 13, wherein the first carrying member further comprises a support shaft, the carrying blade is formed in a spiral shape on an outer circumferential surface of the support shaft along an axial line direction of the support shaft, the carrying blade comprises a small gap part having a narrow gap between adjacent portions of the carrying blade in the axial line direction of the support shaft at the location between the counter blade-side end portion of the magnet and the counter blade, and the developer staying member is implemented by the small gap part.

19. A developing apparatus comprising:

first and second case parts;

first and second opening parts for allowing the first and second case parts to communicate with each other;

a developing roller installed in the first case part;

a first carrying member installed in the first case part to carry, towards the first opening part, developer introduced from the second case part through the second opening part and to supply the developer to the developing roller;

a second carrying member installed in the second case part to carry, towards the second opening part, the developer introduced from the first case part through the first opening part;

a developer discharge hole provided in the first case part at an opposite side to the second opening part;

a counter blade located between the first opening part and the developer discharge hole to carry the developer towards the first opening part; and a developer staying member installed at a region between the counter blade and approximately a counter blade-side end portion of the developing roller to make the developer being carried towards the developer discharge hole by the first carrying member stay in place.

20. The developing apparatus of claim 19, wherein the first carrying member comprises:

a carrying blade to carry the developer towards the first opening part; and a cross-sectional area of a discharge path for the developer from the counter blade to the developer discharge hole within the first case part is less at a developer discharge hole side than at a counter blade side, wherein the developer staying member is implemented by, a magnetic substance to make the developer stay in place by a magnetic force, a portion formed on an outer circumferential surface of a support shaft comprising the carrying blade of the first carrying member, the portion having a larger or a smaller diameter than the carrying blade, a non-installation part formed on a support shaft of the carrying member on which the carrying blade is not installed, or a narrowing gap between adjacent portions of the carrying blade; or wherein the developer staying member is a magnetic substance and installed at a region of the discharge path with the cross-sectional area and formed by a paddle member installed at a location facing the magnetic substance to connect adjacent portions of the carrying blade in an axial direction of the support shaft; or wherein the developer staying member is installed between the counter blade and a downstream to developer discharge hole side of the carrying blade of the first carrying member.

* * * * *